US009441912B2

(12) United States Patent
Kempas

(10) Patent No.: US 9,441,912 B2
(45) Date of Patent: Sep. 13, 2016

(54) MISSILE CONTAINER AND METHOD OF OPERATING A MISSILE CONTAINER

(71) Applicant: DIEHL BGT DEFENCE GMBH & CO. KG, Ueberlingen (DE)

(72) Inventor: Hagen Kempas, Ueberlingen (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 21 days.

(21) Appl. No.: 14/138,340

(22) Filed: Dec. 23, 2013

(65) Prior Publication Data

US 2014/0174283 A1 Jun. 26, 2014

(30) Foreign Application Priority Data

Dec. 22, 2012 (DE) ..... 10 2012 025 314

(51) Int. Cl.
*F41F 3/042* (2006.01)
*F41A 23/20* (2006.01)

(52) U.S. Cl.
CPC ..... *F41F 3/042* (2013.01); *F41A 23/20* (2013.01)

(58) Field of Classification Search
CPC ..... F41A 23/20; F41F 3/042; F41F 3/052; F41F 3/065; F41F 3/073; F41F 3/077; F42B 39/00; F42B 39/002; F42B 39/22; F42B 39/30
USPC ..... 89/1.801–1.806, 1.81, 1.815–1.817, 89/1.819
See application file for complete search history.

(56) References Cited

U.S. PATENT DOCUMENTS

| | | | | |
|---|---|---|---|---|
| 2,981,152 | A * | 4/1961 | Miller, Jr. et al. | 89/1.805 |
| 2,995,986 | A * | 8/1961 | Carlberg | 89/1.802 |
| 3,054,330 | A * | 9/1962 | Carlberg | 89/1.802 |
| 3,101,026 | A * | 8/1963 | Jacobson et al. | 89/1.805 |
| 3,303,740 | A * | 2/1967 | Grayson et al. | 89/1.815 |
| 3,316,808 | A | 5/1967 | Mais | |
| 3,316,809 | A * | 5/1967 | Riedel | F41F 3/04 89/1.815 |
| 3,526,166 | A * | 9/1970 | Pfister | F41A 9/21 89/1.802 |
| 3,800,659 | A * | 4/1974 | Kuiper | 89/40.03 |
| 4,444,087 | A * | 4/1984 | Hunter et al. | 89/1.802 |
| 4,934,241 | A * | 6/1990 | Piesik | 89/1.817 |
| 4,970,937 | A * | 11/1990 | Ward | 89/1.817 |
| 5,911,172 | A * | 6/1999 | Korolenko | 89/5 |
| 5,950,372 | A * | 9/1999 | Al-Sabah et al. | 52/66 |
| 7,854,189 | B1 * | 12/2010 | Fox | 89/1.804 |
| 2010/0282051 | A1 * | 11/2010 | Fleischer | E05D 15/58 89/1.8 |
| 2010/0282150 | A1 | 11/2010 | Onuk | |
| 2012/0152092 | A1 | 6/2012 | Skurdal et al. | |

FOREIGN PATENT DOCUMENTS

| | | | |
|---|---|---|---|
| DE | 1428629 | A1 | 12/1968 |
| DE | 202010006199 | U1 | 8/2010 |

* cited by examiner

*Primary Examiner* — Stephen M Johnson
*Assistant Examiner* — Benjamin Gomberg
(74) *Attorney, Agent, or Firm* — Laurence A. Greenberg; Werner H. Stemer; Ralph E. Locher

(57) ABSTRACT

A missile container has a container housing, a container roof, at least one canister for holding a missile which, in a storage position, is disposed on the container housing, and a movement mechanism for moving the canister from the storage position into an operating position. The elements arranged in the interior of the container housing are protected against external weather influences. In the operating position, the canister is held at least partially outside the container housing by the movement mechanism and the container roof is closed and shields a container interior against the outside.

18 Claims, 15 Drawing Sheets

MISSILE CONTAINER AND METHOD OF OPERATING A MISSILE CONTAINER

CROSS-REFERENCE TO RELATED APPLICATION

This application claims the priority, under 35 U.S.C. §119, of German patent application DE 10 2012 025 314.1, filed Dec. 22, 2012; the application is also related to my copending application Ser. No. 14/138,337, filed Dec. 23, 2013, now U.S. Pat. No. 9,261,329, issued on Feb. 16, 2016, which claims the priority of German patent application DE 10 2012 025 316.8, filed Dec. 22, 2012; the prior and co-filed applications are herewith incorporated by reference in their entirety.

BACKGROUND OF THE INVENTION

Field of the Invention

The invention relates to a missile container having container housing, at least one canister for supporting a missile arranged in a storage position in the container housing, and a movement mechanism for moving the canister from a storage position into an operating position.

So-called surface-to-air missiles (SAMs) or ground-to-air missiles (GTAMs) are used for defense purposes. The missiles are stored in canisters and they are fired from the canister, either vertically or at an incline upwardly. When launching a missile from its canister, a hot jet of waste gas is produced, in the vicinity of which no sensitive components must be located if the destruction of said components is to be avoided. In order to protect the missile container and its inner components against such damage, it is known to lift the canister from the container housing, for example to install it on a carriage of a vehicle and to fire it from there. The hot jet of waste gas is directed freely downwardly and to the side if the missile is shot at an incline, and does not impact on any sensitive components. In order to achieve this, it is necessary however to lift out the canister with its missiles from the container housing and to install it on an appropriate launching device.

Missiles are generally stored over relatively long periods of time and for this purpose are stored in the container housing of the missile container. Even during transport, they are arranged within the container housing of the missile container and are held therein in a firmly closed manner. So as to be able to be made ready for combat, the missiles have to be removed with their canister from the container housing and appropriately positioned such that they can be launched without causing damage as a result of their jet of waste gas.

In order to protect the missiles during storage and transportation, the container housing is intended to be closable in such a manner that the contents are at least splash proof, and therefore the missile container can be transported through rain, wind and snow without internal elements being thereby damaged. However, it is also possible that the missile container has to be kept in a combat-ready state or in an alert state for a long period of time. In this case too it may also be that the missile container is exposed to the weather, whether rain, snow or wind, or also to dust or blown sand in deserts. In order to avoid damage to the elements in the interior of the missile container, it is therefore advantageous if the container housing is also closable in the operating position of the canister. At least parts of the interior of the container housing are intended to be protected by a container roof.

SUMMARY OF THE INVENTION

It is accordingly an object of the invention to provide a missile container and an operating method which overcome the above-mentioned disadvantages of the heretofore-known devices and methods of this general type and provide for a missile container in which elements arranged in the interior of the container housing can be at least partially protected against external weather influences.

With the foregoing and other objects in view there is provided, in accordance with the invention, a missile container, comprising:

- a container housing and a container roof;
- at least one canister for supporting a missile arranged in a storage position in said container housing; and
- a movement mechanism for moving said at least one canister from the storage position into an operating position;
- said movement mechanism holding said at least one canister at least partially outside said container housing in the operating position, and said container roof being closed and outwardly shielding a container interior when said at least one canister is in the operating position.

In other words, the objects of the invention are achieved by a missile container of the type outlined above, with which, in accordance with the invention, in the operating position, the canister is held at least partially outside the container housing by the movement mechanism and the container roof is closed so that it shields the container interior outwardly against the exterior. Devices arranged in the container interior can be protected against external weather influences, and the missile container can be kept in an alert state or combat-ready state over a relatively long period of time.

The operating position of the canister can be a combat position from which a missile held in the missile container is regularly launched. The operating position may be, however, maintenance or repair position, in which the canister is kept for maintaining or repairing the missile or the canister.

The movement mechanism is expediently anchored within the container housing in a manner mounted on the structure such that said movement mechanism has to be passed through the container housing in order to hold the canister outside the container housing. Although said passage can take place through one or more of the container side walls, passage through the container roof or a container upper side is particularly advantageous. The container housing therefore expediently has a cutout through which the movement mechanism is passed in the operating position. If the movement mechanism is arranged outside said cutout in the storage position, the cutout is expediently closed in order to keep the container housing tight even in the storage position.

The missile is expediently a rocket missile, that is to say a missile with a rocket driving mechanism, in particular a ground-to-air missile, a ground-to ground missile or a sea-based missile. The missile is an unmanned missile and expediently equipped with a warhead, which may house a detonation charge. The invention is not limited to missiles and a container for a missile. Instead of a missile, another object can be moved.

The canister is used to support the missile and additionally expediently to store the missile in the closed missile container and advantageously also to hold it in the event of firing. The missile is thus expediently fired from the canister and the canister is in this respect prepared for such a firing procedure. The storage position is a position of the canister in which the missile or the canister is stored over a storage period, for example over a number of months, or even, in particular, over a number of years.

The storage position is a position in which the missile or the canister with the missile is stored over a relatively long period of time. It may also be a transport position, in which the canister and the missile are transported on, or in, a vehicle. The operating position is a position in which the canister is in operation. Such an operation may be a firing of the missile canister, maintenance operation, in which the canister is serviced or repaired, test operation, for example for testing sensors of the canister or of the missile, or another suitable operation of the canister. The operating position is a position different from the storage position, wherein the canister in the operating position is expediently pivoted relative to the storage position.

The container housing is expediently a housing closed around the missile. It expediently has the dimensions of a 20-foot ISO transport container. The missile container can thus be combined and used with typical logistical systems for containers. It is further advantageous if the container housing can be closed in a splashproof manner such that the interior of the container housing is protected against highly damaging weather influences, such as rain or storm. With an embodiment of the container housing extremely similar to a standard transport container, such a weatherproofing can be achieved. In addition, simple and inconspicuous transport is possible. The container housing is expediently equipped with solid side walls and an access door. In addition, a control panel region with a protective covering, for example a protective flap, and in particular a connection for supply lines is additionally provided.

During storage and transport, the missile container or the container housing thereof is expediently closed, as described above. It may also be however that the missile container is located over a relatively long period of time in an alert state or in a state ready for activation, in which the canister is arranged in combat position. In order to protect the interior of the container housing in this state too against external influences over a relatively long period of time, it is advantageous if the container housing is closed even in the combat-ready state of the missile container or in the combat position of the canister. Similarly to the storage or transport state, it is advantageous if the container housing is splashproof in this case also, in particular from all sides.

A plurality of canisters each for supporting at least one missile are expediently arranged on the movement mechanism. A battery of four or eight canisters per canister unit are conventional and are fastened to the movement mechanism as a unit, for example are themselves joined together firmly.

The movement mechanism is used to move the canister from the storage position into the operating position and to this end can comprise a linkage. The movement mechanism is expediently designed to carry out a movement that has more degrees of freedom than a single rotation about a single axis of rotation. In this case, a higher degree of freedom is not necessarily to be understood to mean a higher dimensionality of the movement, since a one-dimensional movement is sufficient. Rather, a more complex movement path compared to a straight line or single circular or ellipsis path is to be enabled, for example a combination of two circular paths having different midpoints.

The container housing advantageously comprises a roof unit by means of which a roof opening in the container housing can be opened and closed again. For this purpose, the roof unit is mounted movably from the remaining container housing such that it can close the roof opening by means of a pivoting movement, a translation movement or a combination movement. The roof unit can comprise a plurality of roof elements, for example two roof wings which are movable symmetrically with respect to each other, or other elements. Good sealing of the container housing is promoted when the roof unit has two roof wings which partially overlap each other in the closed position. A seal which outwardly seals the container interior can be arranged between the two roof wings.

The roof unit and the movement mechanism are expediently coordinated with each other in such a manner that the roof unit is closable both in a position of the movement mechanism in the storage position and in a position of the movement mechanism in the operating position. In the closed state of the roof unit, the container interior is outwardly shielded, wherein, expediently, the entire container interior of the container housing is outwardly shielded and closed. Independently of the roof unit, there may be further openings in the container housing, for example a door for accessing the container interior, a window, a further roof flap or a plurality of these elements, or other elements. The shielding of the container interior outwards here can be understood as meaning that all of these elements are closed.

In an advantageous embodiment of the invention, the container roof has a passage through which the movement mechanism projects in the operating position. The passage can be a recess which is closable by a roof flap or another closure element. The roof flap or the other element is expediently different from the roof unit, such as a roof wing, and is present in addition thereto. If the movement mechanism is not passed through the passage, but rather is positioned elsewhere, the passage is intended to be closed or at least closable in order to be able sufficiently to close the missile container even in the storage position of the canister. It is therefore expedient if the passage is closed, for example by a roof flap, when the movement mechanism is moved out of the passage. The term of the roof flap, like the term of the roof wing, implies a rotational opening or closing movement. However, these terms are not intended to be reduced to such a closing movement, and therefore an element opening or closing in a purely translational manner or in a combination movement is referred to as the roof flap or roof wing.

The passage is advantageously arranged directly next to a region of the roof opening that can be closed by a roof wing. Said roof opening region and the passage are therefore directly adjacent to each other, and therefore the passage and the roof opening form a continuous opening. By this means, the movement mechanism can move out of the roof opening into the passage and therefore can move out of this region of the roof opening that is closed by the roof wing.

The roof flap is advantageously designed in such a manner that it automatically closes when the movement mechanism moves out of the passage. Said closing can take place in a motor-driven manner, spring-driven manner or in another manner. A spring-driven closing can be achieved in this case in a particularly simple, cost-effective and reliable manner.

The roof flap can also be held in a simple manner when said roof flap and the movement mechanism are arranged with respect to each other and designed in such a manner that the movement mechanism presses on the roof flap by moving into the operating position. The movements means can thus press on the roof flap, for example, counter to a spring force which presses the roof flap into the closure position thereof again when the movement mechanism moves out of the passage. The movement mechanism advantageously completely fills the passage, and therefore the container interior is closed, i.e. the passage is also closed, when a roof element is closed and in the position of the movement mechanism in the operating position.

A further embodiment of the invention proposes that the roof unit has at least one roof element, for example in the form of a roof wing, which rests on the container housing. The roof opening can be opened up in a simple manner by movement of the roof element, referred to below in simplified form as roof wing, upwards. Expediently, the roof wing can be lifted upwards completely from the container housing. This can be understood as meaning that the roof wing can be lifted at all of the side edges thereof, for example the four side edges thereof, from the container housing. The capability of being lifted upwards is expediently designed in such a manner that storage of the roof wing in the container housing can be dispensed with. This can make it easier to seal the container housing, since storage of the roof wing in the container housing may not be easily sealable. The lifting expediently takes place in a motor-driven manner. For this purpose, the missile container expediently comprises an opening device, or an opening assembly, for opening the roof wing, in particular by complete raising of the roof wing from the container roof. A single roof wing can be sufficient in order to close the roof opening, with it equally readily being possible for two or more roof wings to be present for this task.

Good sealing of the container housing outwards is promoted when the roof wing engages around the side upper edge of the container side wall from above and to the side. The container side wall is part of the container housing and expediently protrudes vertically upwards. By means of the engagement around the side upper edge from above and to the side, a seal, which is accessible from above, of the container roof can be dispensed with, and therefore water can flow off laterally from the container roof without coming into contact with such a sealing point.

During storage, during transportation or else in the alert state, water, blown sand, leaves or the like may accumulate on the container roof. If the opening of the roof wing is associated with tilting, water flows off, or the dirt slides off, laterally from the roof wing. It is expedient in this case if the water, or the dirt, drops off at a point where it also cannot be blown into the container interior in the event of wind, i.e. expediently drops off a distance away from the container outer wall. For this purpose, it is proposed that the missile container has an opening device for opening the roof wing by pivoting the roof wing upwards and to the side. During the opening, the wing expediently tilts outwards, and therefore, for example, sand slides outwards on the wing without being able to come into contact with the container outer side.

It is beneficial for a simple construction of the opening device for opening the roof wing when the roof wing is mounted pivotably in a single axis of rotation. The axis of rotation is expediently arranged in the container interior, i.e. is engaged around by the container housing. The movable mounting of the roof wing, i.e. a bearing, a hinge or the like, is likewise positioned within the container interior.

A lateral movement of the roof wing during opening can be achieved in a simple manner when the axis of rotation is arranged by more than 5% of the container width under the container upper edge on which the roof wing rests. In particular, the axis of rotation is arranged by more than 10%, expediently even by more than 25% of the container width, under the container upper edge.

In order to avoid a lateral dipping of the roof wing right at the beginning of the opening movement, or at least to keep said dipping small, it is advantageous when the axis of rotation about which the roof wing pivots is arranged by less than 20%, in particular less than 10% of the container width away from the lateral container wall.

A lateral sealing surface of the container housing and/or of the roof wing can be sealed in a particularly simple and reliable manner when the roof wing starts moving more horizontally onto the side upper edge of the container side wall during closing. For this purpose, it is advantageous when the missile container has an opening device for moving the roof wing by pivoting the roof wing in such a manner that the outer side of the roof wing is moved during closure with an angle of displacement of less than 20°, in particular less than 10°, to the horizontal towards the container wall. In this case, the inner side of the roof wing advantageously lifts more upwards than to the side.

In order to protect a seal, it is furthermore advantageous when the roof wing has an inner cover which, in the open state of the roof wing, covers the side upper edge of the container housing such that the latter is protected. A seal on the side upper edge or at the side upper edge can also be protected by this means. The covering takes place at least over 50% of the entire length of the side upper edge.

In order to be able safely to access the missile container, it is advantageous when, both in the open and in the closed state of the roof wing, the opening device is force-free. This can be achieved in a simple manner when, in the open state, the roof wing is supported on a supporting means such that the opening device is force-free and the roof wing remains in a secure open position. The supporting can take place directly or indirectly, for example via one or more elements of the opening device. The supporting means can be an element of the container housing, for example a container side wall.

The invention in its general form is directed towards a missile container with a container housing, a missile mounted therein and a container roof. In order to at least partially protect elements arranged in the interior of the container housing against external weather influences, it is proposed that, according to the invention, the missile, in the launch position thereof, is at least partially held outside the container housing and the container roof is closed and outwardly shields a container interior. Details of the invention that are described above and in the description of the figures can also be combined with this general form.

The invention is furthermore directed towards a method for operating a missile container having container housing and at least one canister stored therein for supporting a missile, in which the canister is moved by a movement mechanism from a storage position into an operating position.

In order to at least partially protect elements arranged in the interior of the container housing against external weather influences and nevertheless to permit a movement of the missile out of the container housing, it is proposed that, according to the invention, a roof wing of the container housing is opened and a roof opening is thereby released.

Expediently, after the release of the roof opening, the canister is moved from the storage position into an operating position and, in the process, is moved through the roof opening. Furthermore advantageously, the roof wing is closed again in the operating position of the canister, as a result of which the roof opening is closed. By this means, the container housing advantageously achieves an at least splashproof state, as a result of which elements in the container interior are readily protected even in the operating position.

In an advantageous embodiment of the invention, it is proposed that the movement mechanism when moving into the operating position presses on a closure, or a closure means or closure flap, of the container roof, said closure thereby releasing a passage in the container roof. The closure can be opened without a dedicated motor drive, and therefore it can be produced in a simple manner.

With the same advantage, when the movement mechanism moves out of the operating position, the closure closes in a spring-driven manner and closes the passage.

The container interior can be readily protected from dirt when the roof wing when moving out of the closure position thereof pivots to the side and at the same time moves to the side such that water on the roof wing flows off laterally and drops off from the container side wall at a distance therefrom. Water, sand or dirt can be reliably jettisoned from the container roof, or roof wing, without entering the container interior.

The invention additionally relates to a method for operating a missile container having a container housing and at least one canister stored therein for supporting a missile, in which a roof wing of the container housing is open and the canister is moved by a movement mechanism from a storage position into an operating position at least partially through the open container roof. In order to protect elements in the container interior, it is proposed that, according to the invention, while the movement mechanism remains in the operating position, the roof wing is closed again and at least partially outwardly shields a container interior.

The above-described method features can also be combined individually, in multiple or in total with this refinement of the invention. In addition, the above-described device features can also be combined with a method according to the invention and the method features can also be combined with the missile container according to the invention.

The description provided above of advantageous embodiments of the invention contains numerous features which are sometimes reproduced in the individual dependent claims combined in multiple. These features will also expediently be considered individually however by a person skilled in the art and combined to form sensible further combinations.

The above-described properties, features and advantages of this invention, and also the way in which these are achieved can be understood clearly and explicitly in conjunction with the following description of the exemplary embodiments, which will be explained in greater detail in conjunction with the drawings. The exemplary embodiments are used to explain the invention and do not limit the invention to the combination of features specified therein, including with respect to the functional features. In addition, features of any exemplary embodiment suitable for this purpose can also be considered explicitly in an isolated manner, removed from an exemplary embodiment, introduced into another exemplary embodiment for supplementation thereof, and/or combined with any one of the claims.

DETAILED DESCRIPTION OF THE INVENTION

Figure 1:
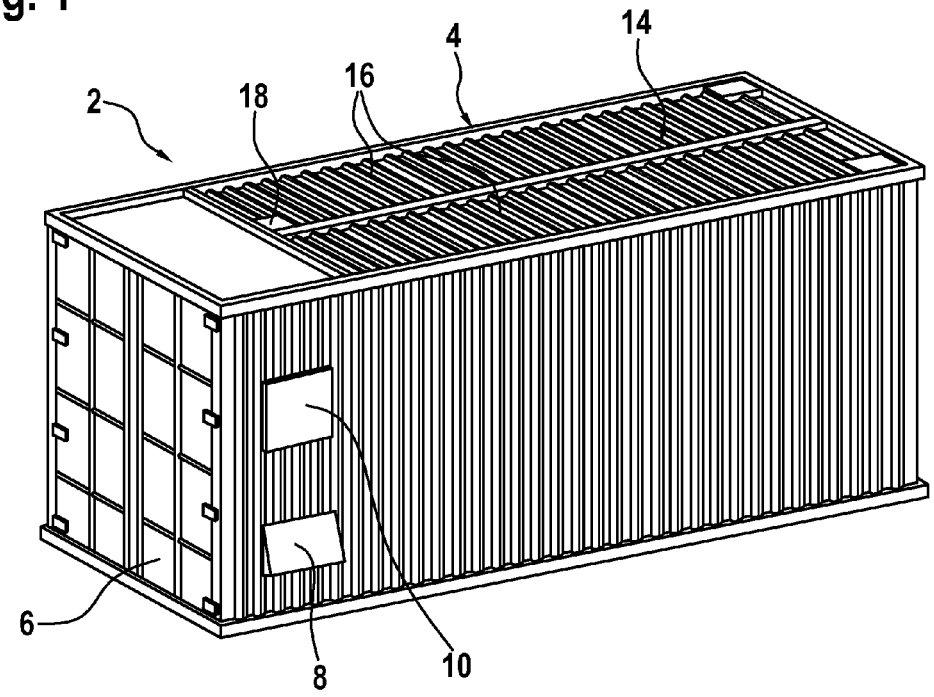
FIG. 1 shows a missile container in a storage or transport state with closed container housing.

Referring now to the figures of the drawing in detail and first, particularly, to FIG. 1 thereof, there is shown a missile container 2 having a closed container housing 4. The container housing 4 has the dimensions of a standard 20-foot container (4.1 meter, intermodal ISO container) and also contains the standardized fastening recesses and fastening means for fastening to other 20-foot containers and appropriate loading devices. On its front side, the container housing 4 comprises an access door 6 for entering a container interior. The door is formed similarly to conventional container doors. From the outside, the missile container 2 likewise corresponds in terms of shaping and design to a 20-foot ISO transport container. As is conventional for example with cooling containers, the missile container 2 comprises an interface 8 for connection to a power supply, wherein one or more further connections are also optionally possible, for example a data connection. The missile container 2 further comprises a cover 10, by means of which a display and input device 12 (see FIG. 3) arranged behind it is externally protected.

On its upper side, the container housing 4 has a container roof 14 with two symmetrical roof wings 16, which each extend over more than half the length of the missile container 2. At the rear end of the container roof 14, two roof flaps 18 are arranged and are illustrated in an enlarged manner in FIG. 2.

Figure 2:
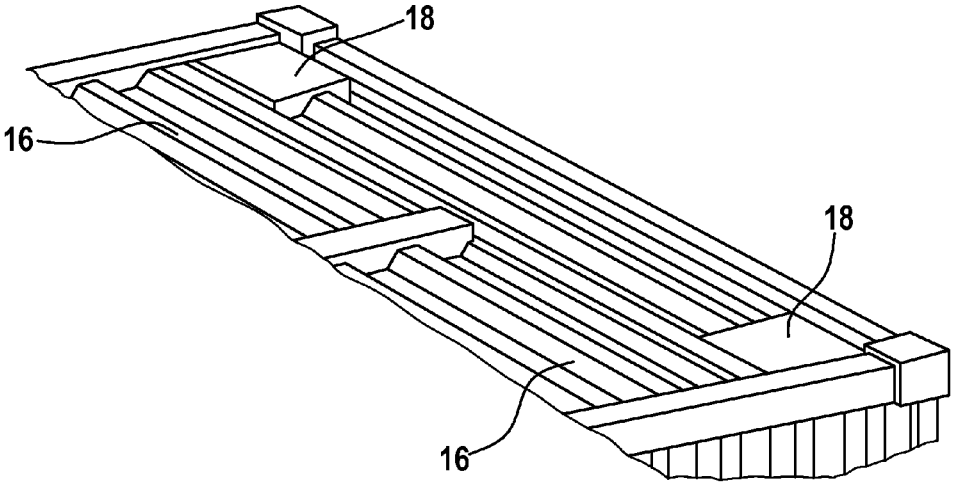
FIG. 2 shows a detail from the container roof of the missile container from FIG. 1.

FIG. 2 shows a detail of the rear container roof 14 of the missile container 2. The two roof flaps 18 arranged at the rear end of the container roof 14 each border a roof wing 16 and, similarly to the roof wings 16, are to open such that a roof opening released by the roof wings 16 borders the roof opening released by the roof flaps 18 such that a single large roof opening is produced.

Figure 3:
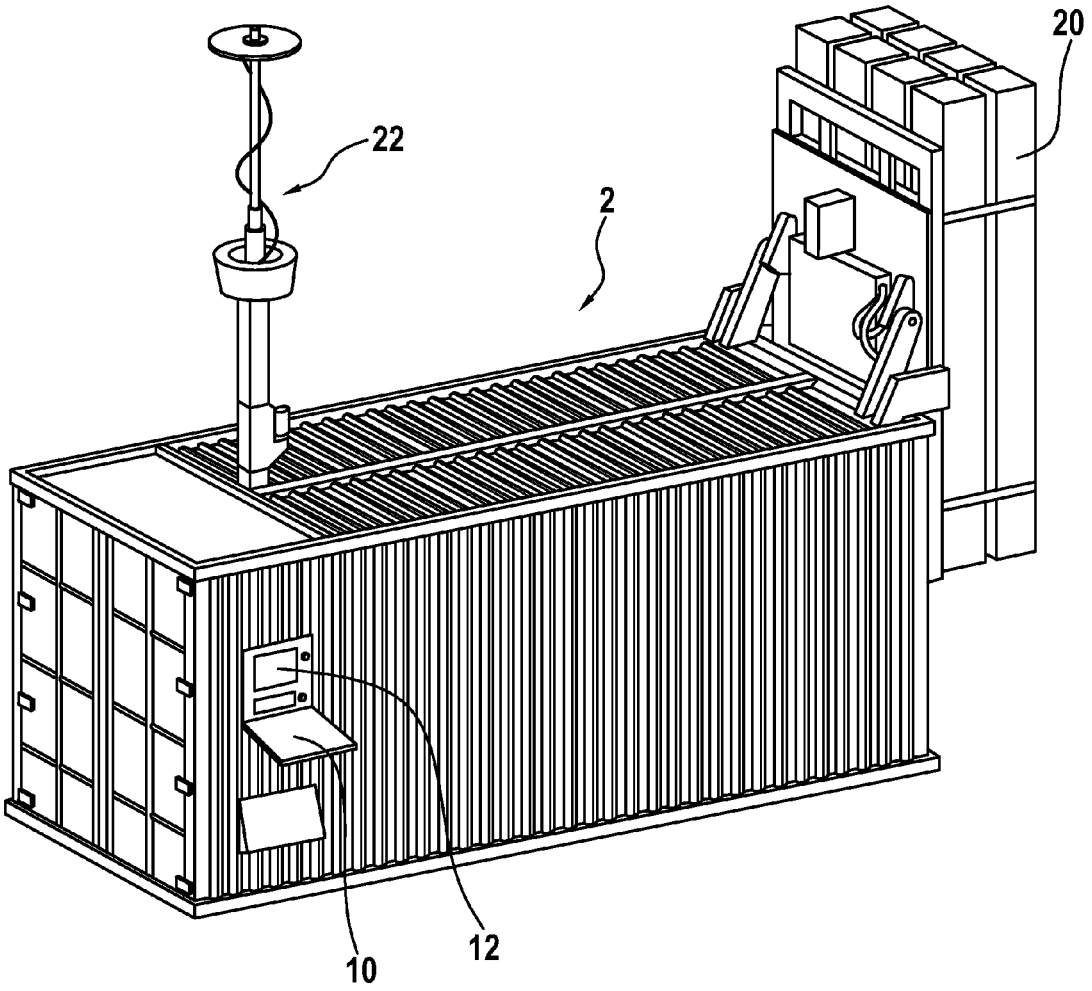
FIG. 3 shows the missile container in an operating position, likewise with closed container housing.

FIG. 3 shows the missile container 2 likewise in a closed state, the container housing 4 is therefore closed, however canisters 20 and missiles stored therein are held outside the container housing 4 and are arranged in an operating position. An antenna 22 is also folded out and is located outside the container housing 4. The cover 10 is open, such that a display and input device 12 arranged therebehind is accessible.

Both in the state shown in FIG. 1, in which the canisters 20 are stored in a storage position within the container housing 4, and in the state shown in FIG. 3, in which they are arranged outside the container housing, the missile container 2 is closed insofar as the container interior, which is enclosed by the container housing 4, is largely protected against weather influences of the surrounding environment. The container housing 4 is thus rainproof and splashproof and also impervious to sand and dust in the two states, such that elements in the container interior are protected against these influences.

The state of the missile container 2 shown in FIG. 1 is a storage and transport state, in which the container housing 4 is firmly closed and protects the device in the container interior. By contrast, the state shown in FIG. 3 is an operating state of the missile container 2, in this case a combat state. The missile container 2 may also remain in this state for a long time without the device in the container interior being exposed to the corresponding external influences, for example rain or, at high wind, blown sand. In the operating position, the canisters 20 are vertically aligned with the front side of the canisters pointing upwardly, such that the missiles stored in the canisters 20, when their rocket driving mechanism is launched, exit upwardly from the corresponding canister 20 by means of the rocket thrust and are launched vertically upwardly.

In order to minimize the aftereffects of the jet of waste gas of the launching missile on the container housing 4, the canisters 20 are arranged outside the container housing 4 and are additionally positioned at a suitable height above the ground. The height of the lower edge of the canisters 20 is at least 80 cm, in particular at least 1 m. The container rear wall, which is not shown in the figures, is always closed, such that gases of the hot jet of waste gas do not infiltrate the interior of the container housing 4.

The missile container 2 can be used universally. It can be used both standing on a fixed flooring and on a commercial vehicle. A use on a ship or other objects to be protected, for example an oil platform, is also easily possible.

Figure 4:
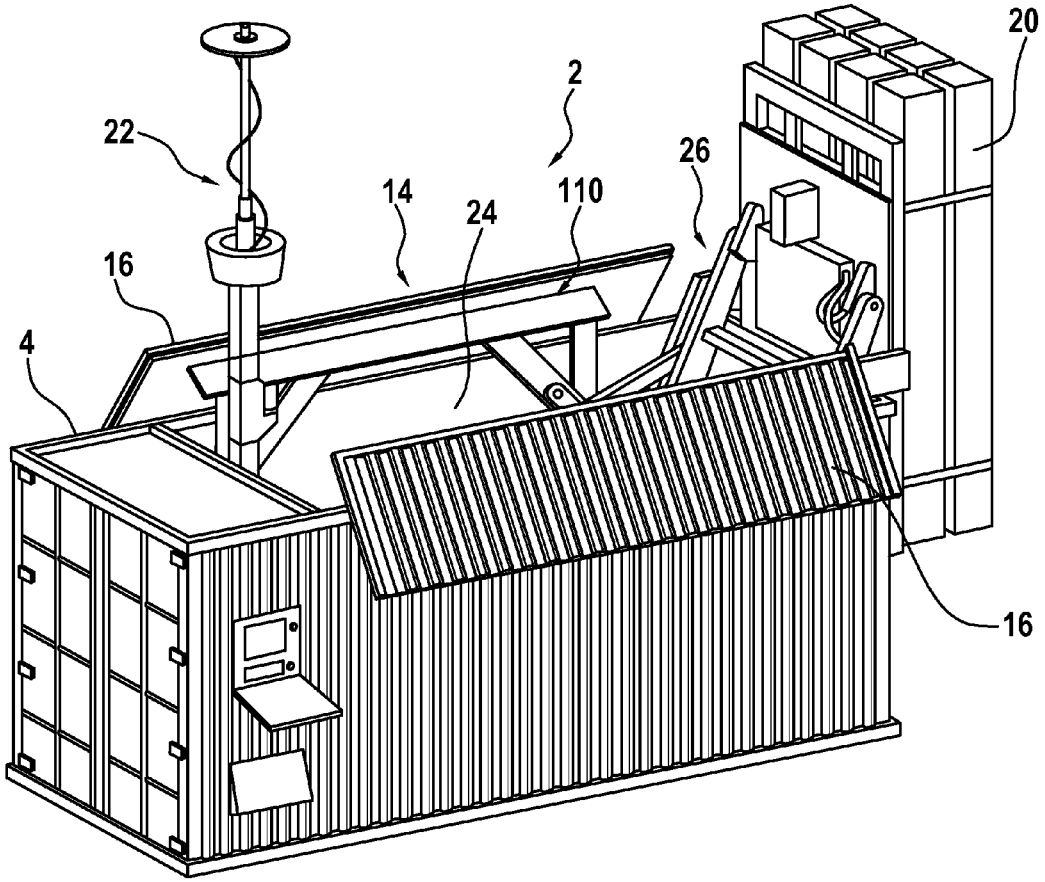
FIG. 4 shows the missile container with canisters held in the operating position and with open container roof.

FIG. 4 shows the missile container 2 in an operating position of the canister 20, but with open container roof 14. The two roof flaps 16 are pivoted upwardly and to the side and thus release a roof opening 24 of the container housing 4. The canister 20 in the container interior can be moved out again from the container interior through this roof opening 24. To this end, the missile container 2 comprises a movement mechanism 26, which is illustrated more clearly in FIG. 5 by the cut-away illustration of the missile container 2.

Figure 5:
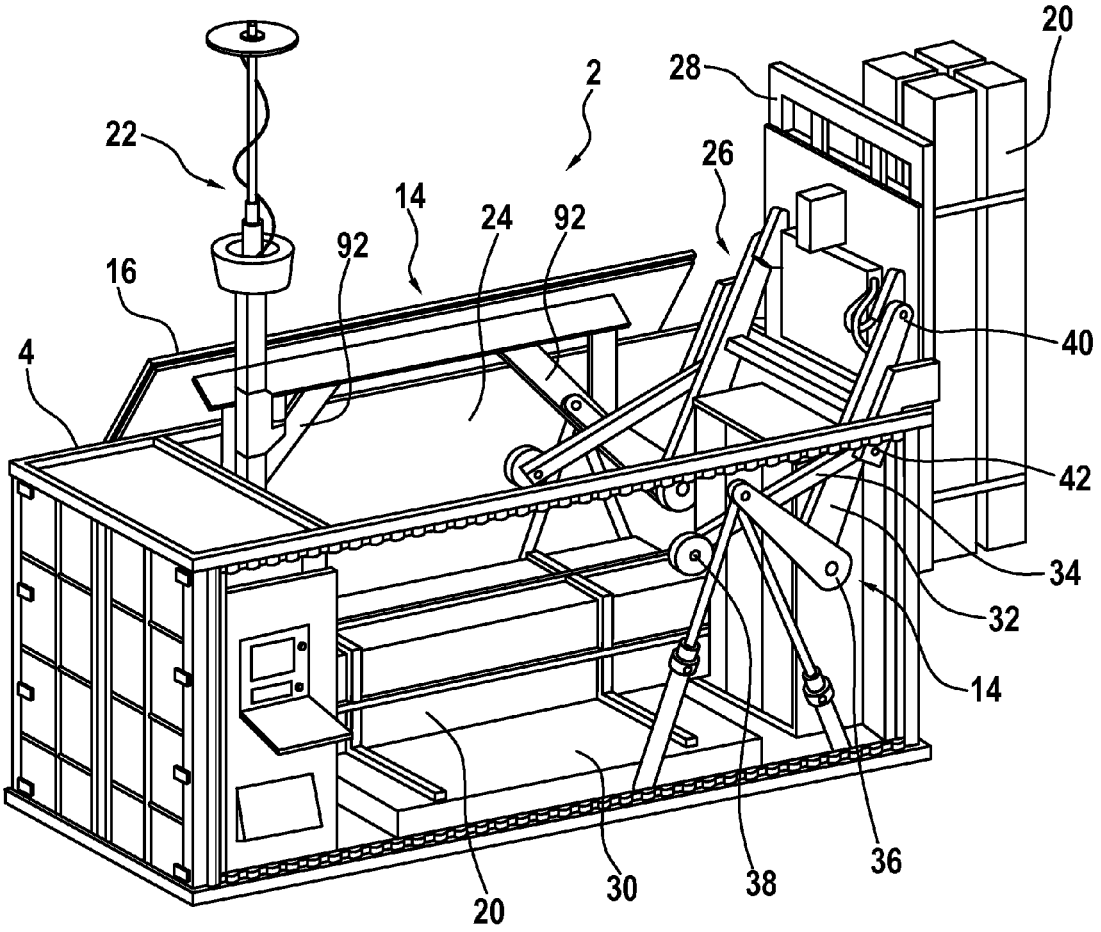
FIG. 5 shows the missile container from FIG. 4 in a partly cut-away view.

FIG. 5 shows the missile container 2 from FIG. 4 in an illustration in which a side wall of the container housing 4 is cut away and is therefore illustrated in an open manner. For the sake of improved clarity, one of the roof wings 16 has been omitted in the illustration. In addition, only four of the eight canisters are fastened to a holding unit 28 of the movement mechanism 26 and are used in the state shown in FIG. 3. The other four canisters 20 are arranged in the storage position in the container interior and rest on a base 30 of the missile container 2. In this respect, FIG. 5 shows a loaded state of the missile container 2, in which the stored canisters 20 are already introduced into the missile container 2, but are not yet fastened to movement mechanism 26.

The movement mechanism 26 comprises a kinematic linkage, which in this embodiment has two axially symmetrical units on both longitudinal sides of the container. Here, a side wall of the container constitutes the stationary part of the linkage in each case. The holding unit 28 forms the movable part of the linkage and is connected to or forms the two rockers or coupling members of the two units of the linkage.

The two units of the movement mechanism 26 are each formed as a linkage 46 in the form of a four membered kinematic chain. The container housing 4 is used as a housing member or stationary housing element. The holding unit 28 serves both units as a coupler or coupling member or operating member. The linkage 46 comprises a leverage having four housing-fixed rotation points.

Each linkage 46 comprises two movable members 32, 34 in the form of rigid elements, for example rods. Each of the movable members 32, 34 is connected at a housing-fixed point of rotation 36, 38 to the housing member or the container housing 4 in a rotatable, but otherwise stationary, manner. The movable members 32, 34 are also connected via movable rotation points 40, 42 to the operating member or the holding unit 28. The rotation points 40, 42 are in this case mounted rigidly relative to the coupling member or the holding unit 28.

Parts of the linkage 46 are located next to the holding unit 28. This embodiment permits narrow elements, such that a very broad holding unit 28 can be used or the arrangement of movement mechanism 26 and canisters 20 can be formed in a particularly compact manner.

Figure 6:
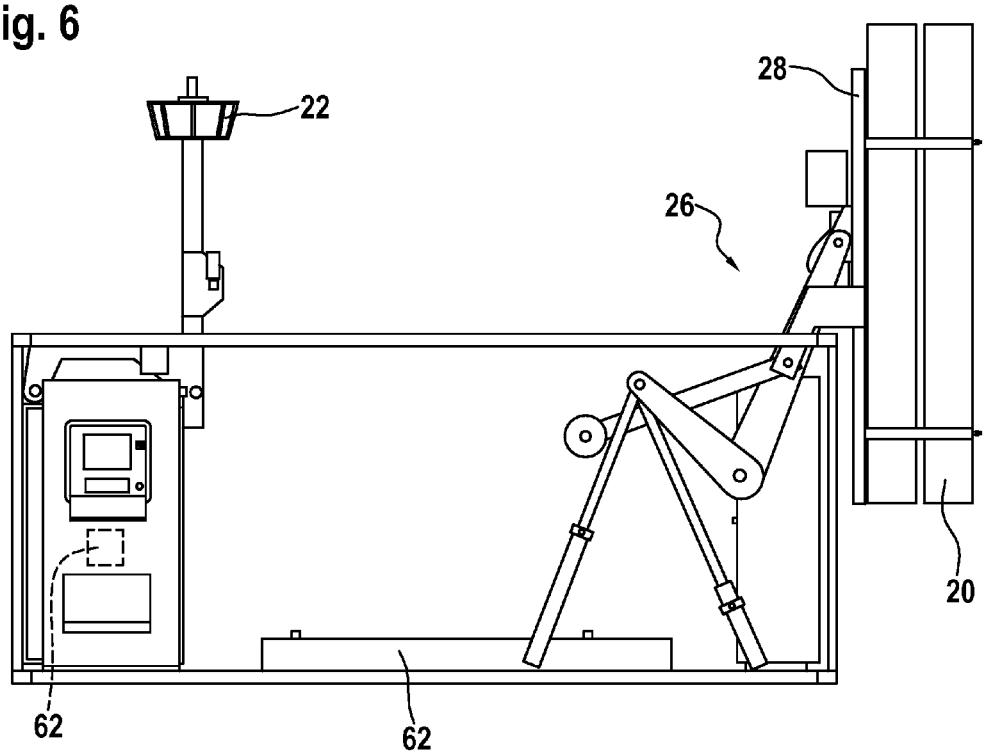
FIG. 6 shows a schematic side view of the missile container with canisters in the operating position.
Figure 7:
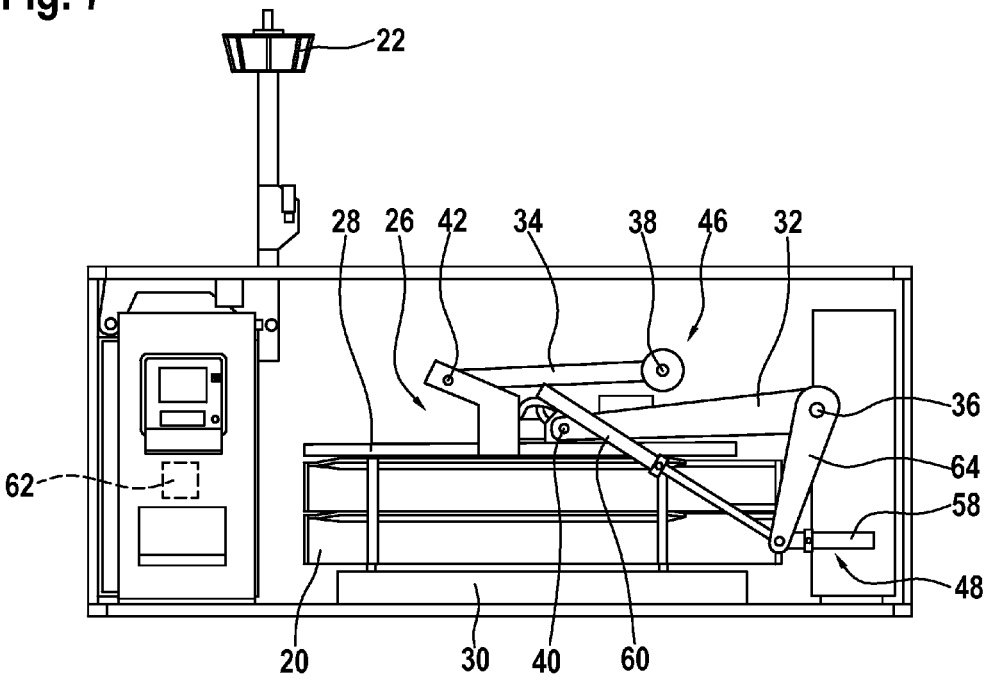
FIG. 7 shows the missile container from FIG. 6 with canisters in the storage position.

The linkage 46 is illustrated from the side in FIGS. 6 and 7, such that the front unit covers the axially symmetrical rear unit. FIG. 6 shows the canisters 20 in this case in the same position as FIG. 5, wherein, in contrast to FIG. 5 however, all canisters 20 are arranged on the movement mechanism 26. FIG. 7 shows the movement mechanism 26 and the canisters 20 in the storage position. The canisters 20 are set down on the base 30, for example are inserted there, and the movement mechanism 26 is fastened to the canisters 20.

Figure 11:
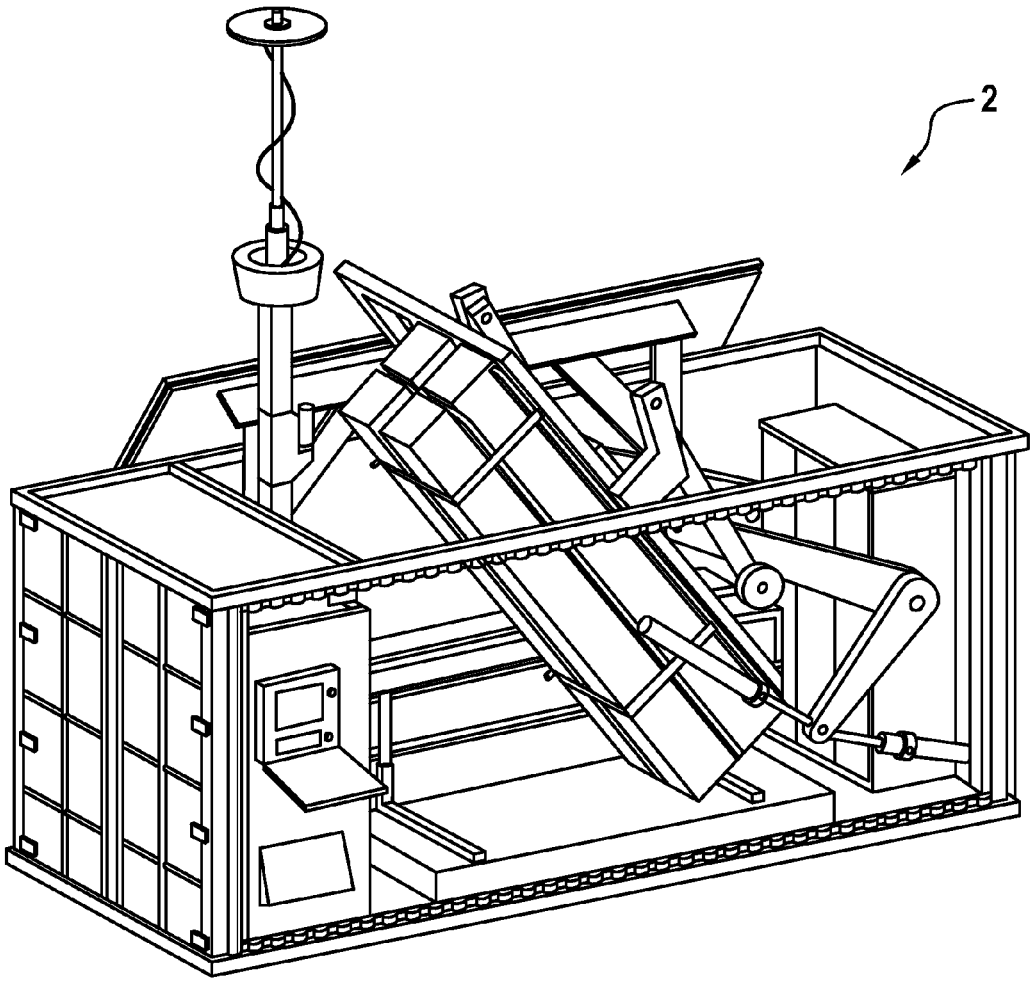
FIG. 11 shows the canisters as the pivoting process is continued further.
Figure 12:
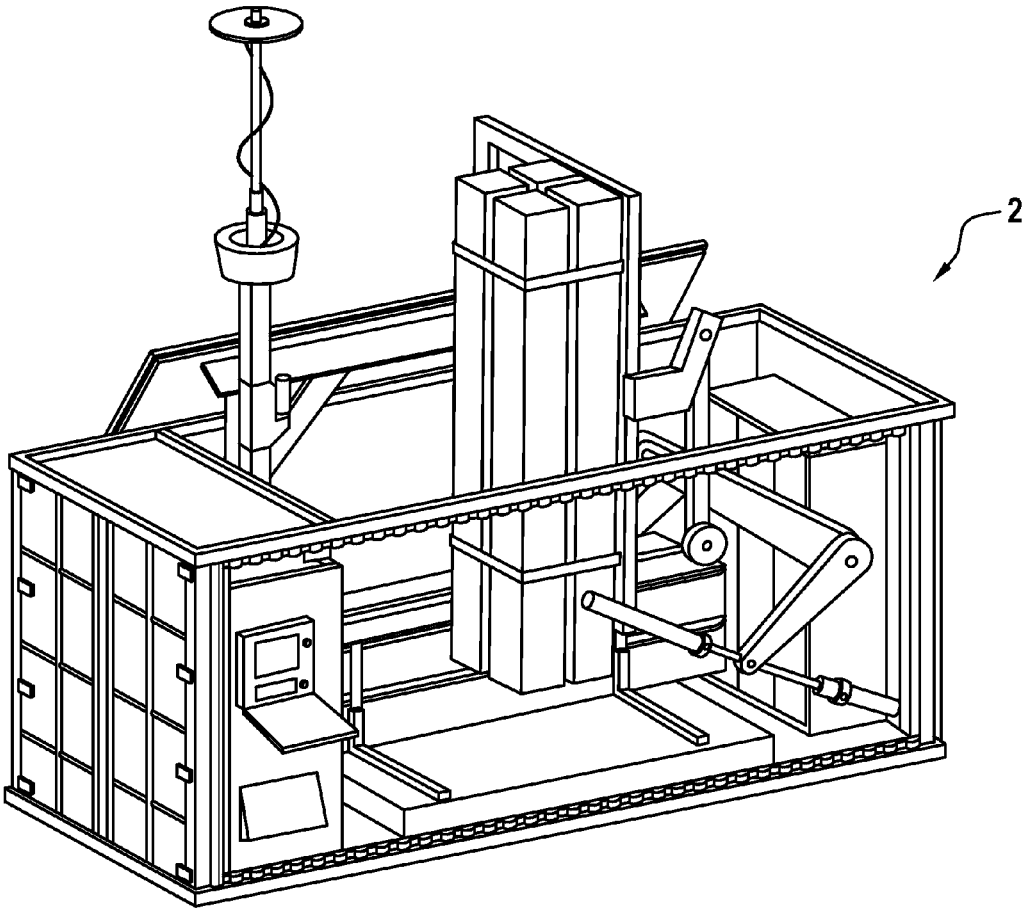
FIG. 12 shows the canisters aligned vertically and with the rear-wall end pointing upwardly.
Figure 13:
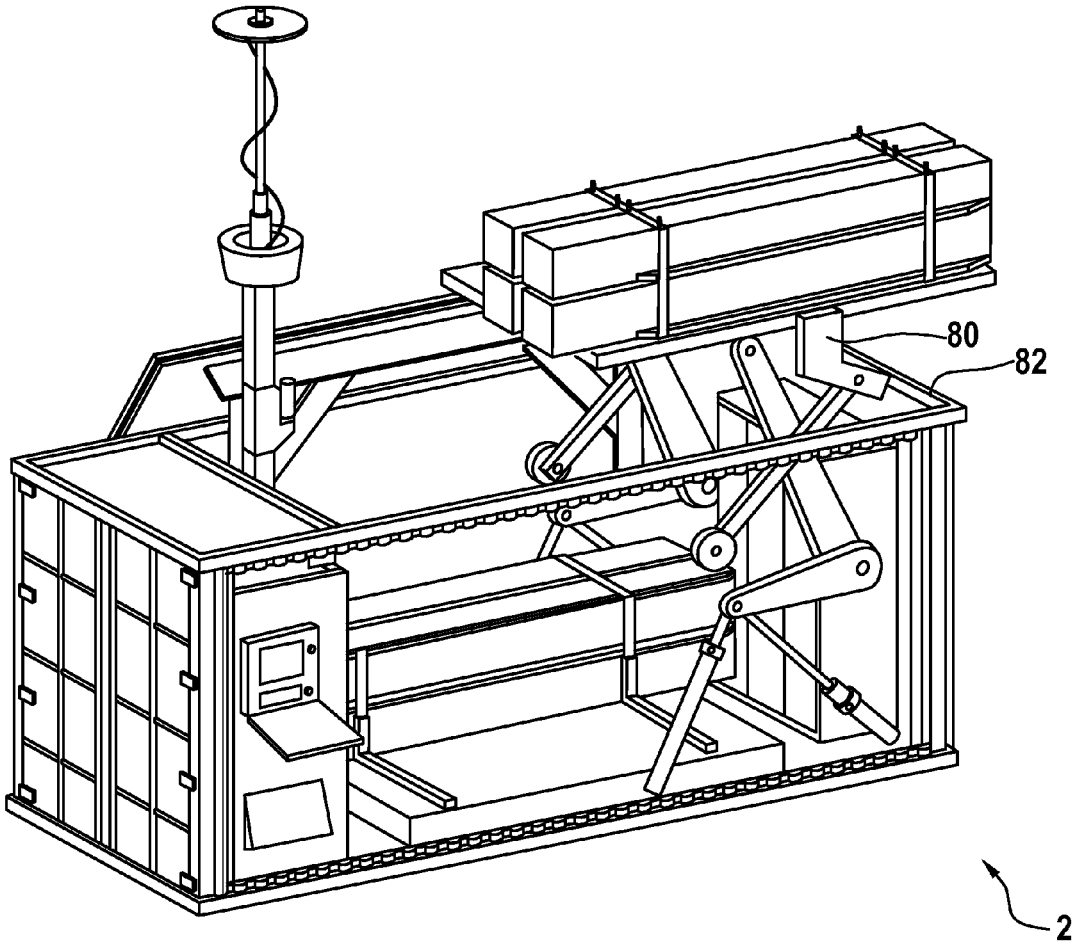
FIG. 13 shows the canisters fully lifted out from the container housing and in a horizontal position.

In FIGS. 8 to 13, a course of movement of the movement mechanism 26 or of the canisters 20 from the storage position into the operating position is illustrated, wherein the operating position from FIG. 5 is to be considered as the end of the last region of the course of movement between the positions from FIG. 13 and FIG. 5. The movement paths of this course of movement are reproduced schematically in FIGS. 14 and 15. Such a course of movement is described hereinafter.

Figure 8:
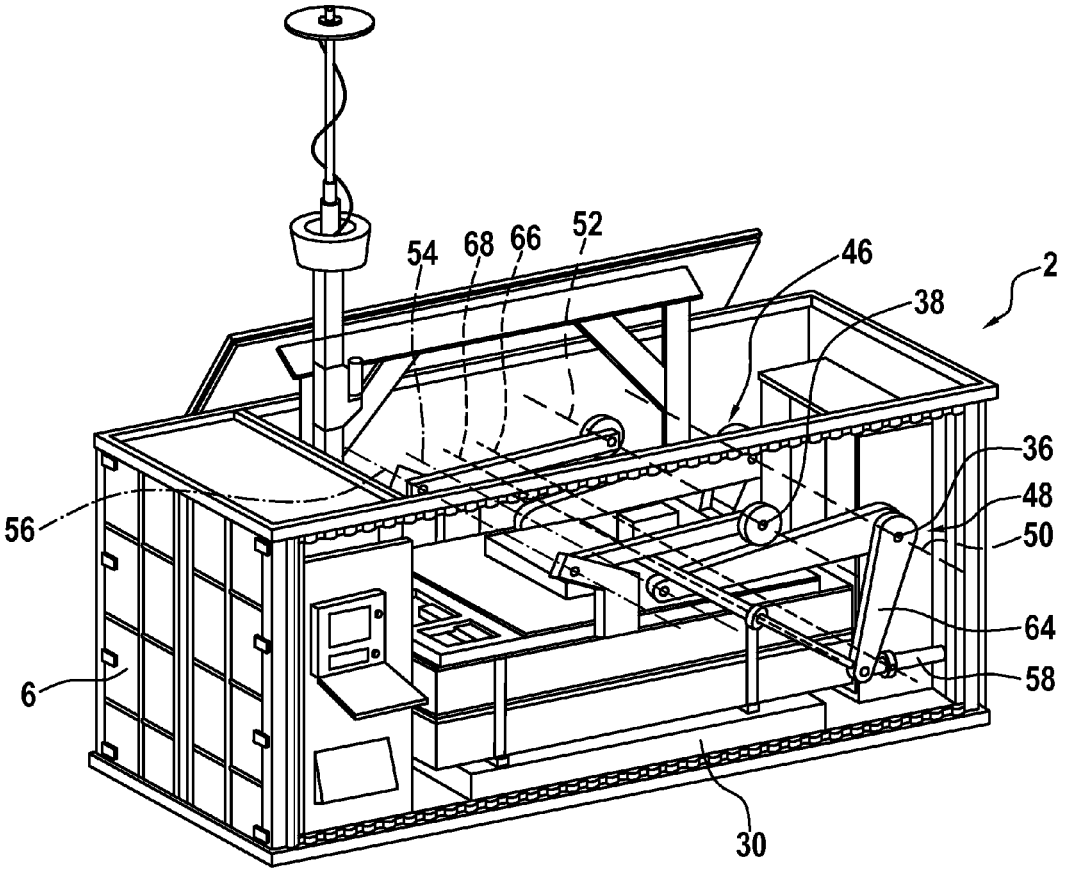
FIG. 8 shows the missile container from FIG. 5 with canisters in the storage position.

FIGS. 7 and 8 show the canisters 20 or the movement mechanism 26 in the storage position. In this position, the canisters 20 are connected at least in a form-fitting manner to the container housing 4, for example via the base 30, such that a horizontal movement of the canisters 20 relative to the container housing 4 is blocked. The movement mechanism 26 or its holding unit 28 is lowered from above towards the resting canisters 20 and is connected thereto such that the canisters 20 are rigidly connected to the holding unit 28 in all directions.

Figure 9:
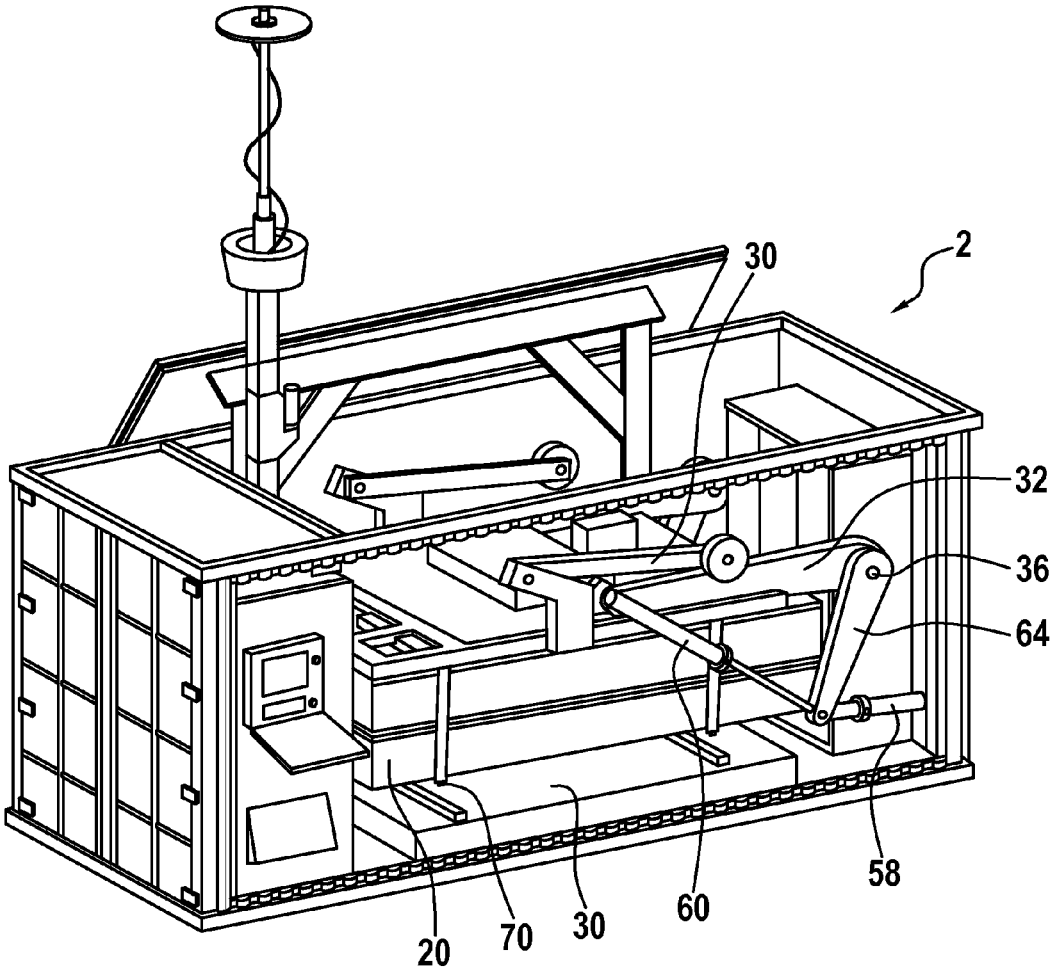
FIG. 9 shows the missile container from FIG. 8, in which the canisters are lifted from the storage position vertically upwardly.

A first part of the course of movement is illustrated by FIGS. 8 and 9. The canisters 20 are lifted upwardly slightly from the base 30. This is achieved in that a movement motor 48 of the movable member 32 rotates about the rotation point 36. It can be seen from FIG. 8 that the two units or linkages 46 are arranged opposite one another in the container housing 4, such that their two rotation points 36 form a fixed axis 50, about which the movable member 32 of both linkages 46 is rotated. In FIG. 8, a further fixed axis 52 is indicated and interconnects the two housing-fixed rotation points 38. The two movable members 34 of the two linkages 46 rotate about this fixed axis 52. Both fixed axes 50, 52 are illustrated in FIG. 8 by long dashes.

Due to the rotation of the movable members 32 of the linkages 46, the movable rotation point 40 thereof also rotates about the housing-fixed rotation point 36. The two movable rotation points 40 form a pivot axis 54, which runs through the two movable rotation points 40 and is illustrated in FIG. 8 by a dot-and-dash line. A further pivot axis 56, which runs through the rotation points 42 of the movable members 34 of the two linkages 46 is also illustrated by a dot-and-dash line. This pivot axis 56 rotates in a circular manner about the fixed axis 52.

The degree of freedom of the movement of the holding unit 28 or of the canisters 20 with respect to the container structure or the stationary container housing 4 is implemented merely by means of rotary joints. Each linkage 46 therefore produces the curve-line movement merely from pivoting movements about two stationary fixed axes 50, 52.

The movement of the movement mechanism 26 is generated by two movement motors 48, wherein each linkage 46 is assigned a movement motor 48. Each movement motor 48 comprises two motor units 58, 60, which are both formed as thrust bar linkages. In the shown exemplary embodiment, both motor units 58, 60 are hydraulic cylinders, which are connected to a hydraulic pump and are controlled by a control means 62. The hydraulic cylinders act directly on the main bearing member 32 of the linkage 46. The driving power is transmitted via four hydraulic cylinders, two on each side. In the event of a hydraulic leak, the holding unit 28 can therefore be stopped in any position in order to avoid subsequent damage.

The two motor units 58, 60 each act on a single lever 64 of the linkage 46 that is connected rigidly to one of the movable members 32, 34, that is to say the movable member 32 in the exemplary embodiment shown in the figures. The drive for the movement of the movement mechanism 26 acts only on one transmission element, in this case the movable member 32. Both motor units 58, 60 generate the movement of the movement mechanism 26 by a change in length, that is to say a contraction and expansion. In this case, both motor units 58, 60 can generate the movement force exclusively by expansion, or at least one of the motor units 58, 60 is additionally designed to apply movement force into the movement mechanism 26 by contraction. This is the case here with the motor unit 60.

In the present exemplary embodiment, each movement motor 48 comprises exclusively motor units 58, 60 which are effective in a length-variable manner and which are each pivotable about a fixed axis 66, 68. These two fixed axes 66, 68 are illustrated in FIG. 8 by short dashes and connect the corresponding motor units 58 and 60 of the two movement motors 48. It is also possible however to produce the movement of the movable member 32 by another movement motor without such fixed axes 66, 68.

The bearing mounts for the fixed rotation points 36, 38 and those for the rotation points of the motor units 58, 60 lie together in a relatively small region, such that the necessary highly loaded structure regions are not to be guided over large distances. A four-sided shape formed by the four fixed axes 50, 52, 66, 68 in this case comprises a maximum extension that is smaller than half a canister length.

Due to the drive of the two movement motors 48, the canisters 20 move in translation from the storage position shown in FIG. 8 away from the base 30, in this exemplary embodiment vertically upwardly. Such a movement in translation has the advantage that holding members 70, which ensure the fixing of the canisters 20 on the base 30, can be removed in a tilt-free manner from the base 30 or the canisters 20. In the exemplary embodiment shown in the figures, a holding member 70 engages in a recess in the base 30, and the holding member 70 is thus drawn from the corresponding recess by the movement in translation upwards.

Figure 14:
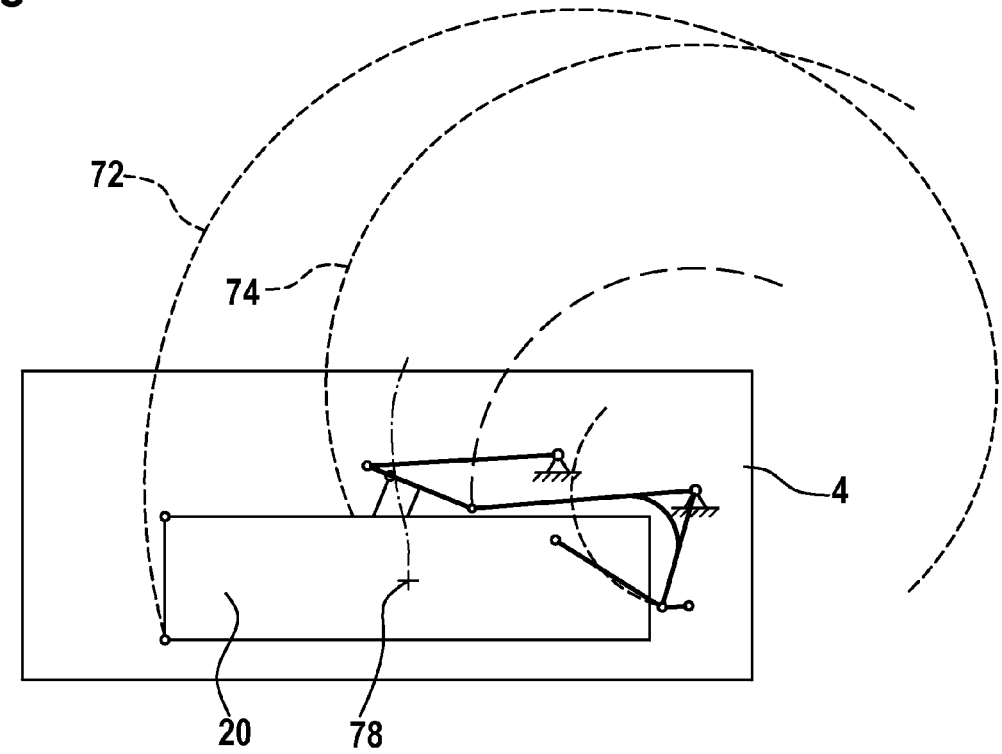
FIG. 14 shows a schematic side illustration of the container housing and the canister in the storage position with movement curves of the canister of its movement from the storage position into the operating position.
Figure 15:
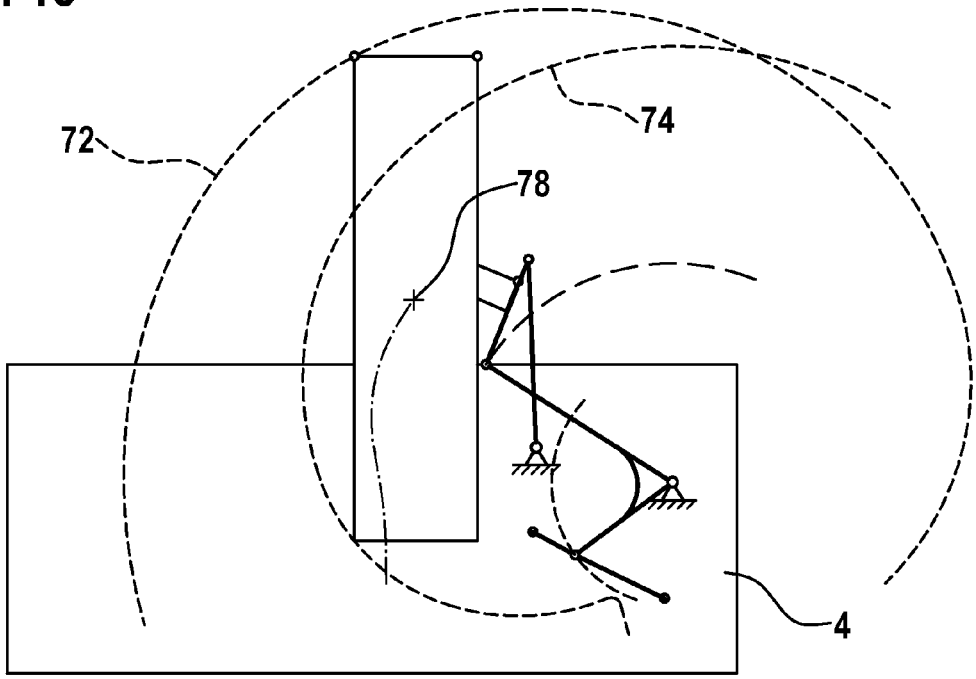
FIG. 15 shows the canister from FIG. 14 in a position rotated through 90° over the indicated movement paths.

This movement in translation is illustrated in FIGS. 14 and 15 by the start of the movement paths 72, 74, which are illustrated in FIGS. 14 and 15 in a dashed manner. The movement path 72 of the front lower end of the canister 20 and the movement path 74 of the rear lower end of the canister 20 are illustrated. From the front movement path 72, it can be seen that the front side of the canister is moved substantially vertically upwardly, wherein an angular deviation of up to 20°, in particular up to 10°, is harmless and is also included in this context by the term "vertical translation". From the rear movement path 74, it can be seen that the rear end of the canister 20 is also initially lifted upwardly, such that the movement in translation is produced from the upwards lifting of the front and rear end of the canister 20. As can be seen from FIG. 15, the first part of each of the two movement paths 72, 74 are parallel to one another, thus producing the movement in translation, in this exemplary embodiment substantially vertically upwardly. This translation part of the movement runs over at least 110 cm, in particular over at least 15 cm. To ensure reliable release, even with relatively large holding members 70, the translation part of the movement shown in FIG. 15 is approximately 25 cm.

Whilst the front end of the canister 20 is lifted continuously upwardly as its movement continues, the movement of the rear part of the canister 20 after the translation phase makes a sharp deflection of at least 60°, in the exemplary embodiment shown even of 90°. The translation phase transitions into a rotation phase of the canister 20. In the rotation or pivot phase, the part of the canister 20 arranged to the rear in the storage position moves substantially horizontally. The transition between vertical and horizontal movement is shorter than the movement in translation, in the shown exemplary embodiment just a few centimeters.

The transition from the translation movement phase to the rotational movement phase of the canister 20 occurs very sharply, as can be seen from the movement paths 72, 74 from FIG. 15. This sharp transition is advantageous, since an absolutely exact movement in translation can be used initially to release the canister 20 from the container housing 4, for example from the base 30. The rapid onset of the rotational movement phase leads to a relatively low volume requirement of the overall movement of the canister 20 from its storage position into its operating position. Due to this type of movement, the movement can therefore not only be kept compact, but a relatively large amount of space of the container housing 4 can also be used for other objects, for example switch cabinets 76, such that a compact design of the missile container 2 is enabled on the whole.

The movement of the canister 20 vertically upwardly is enabled by the position of the fixed axis 50 relative to the pivot axis 54 and of the fixed axis 52 relative to the pivot axis 56. The two axis pairs formed of fixed axis 50 and pivot axis 54 and fixed axis 52 and pivot axis 56 each form a plane that is arranged substantially horizontally. The first part of the movement paths 72, 74 thus takes place by a lifting of the two pivot axes 54, 56 substantially vertically upwards. The movement in translation can be achieved by the high degree of parallelism of these two planes in the storage position. Due to the different lengths of the two movable members 32, 34, this parallelism disappears over the course of the movement, whereby a pivoting of the canister 20 occurs. This only occurs however when the movable member 32 or the plane formed from the fixed axis 50 and the pivot axis 54 has moved away from the horizontal.

A further criterion of the movement paths 72, 74, which leads to a low space consumption of the movement paths 72, 74 or of the canister 20 over the course of its movement is that the geometric center of gravity 78 of the canister 20 not only moves vertically upwards during the translation phase of the movement, but also during the first part of the rotational movement. This is shown in FIGS. 14 and 15 by the dot-and-dash line of movement of the center of gravity 78. This movement path of the center of gravity 78 remains substantially vertical until the center of gravity 78 has left the container housing 4. Only then does a significant pivoting of this rotation point path from the straight line, and in particular from vertical, start. During the phase of the rotation point path within the container housing 4, a deviation of up to 20%, in particular up to just 10% at most, in a direction transverse to the primary direction of movement of the rotation point 78, therefore in the shown example at most 10% to the front, rear or side relative to the primary movement upwardly, is still to be considered as a straight path and in particular a vertical path.

Figure 10:
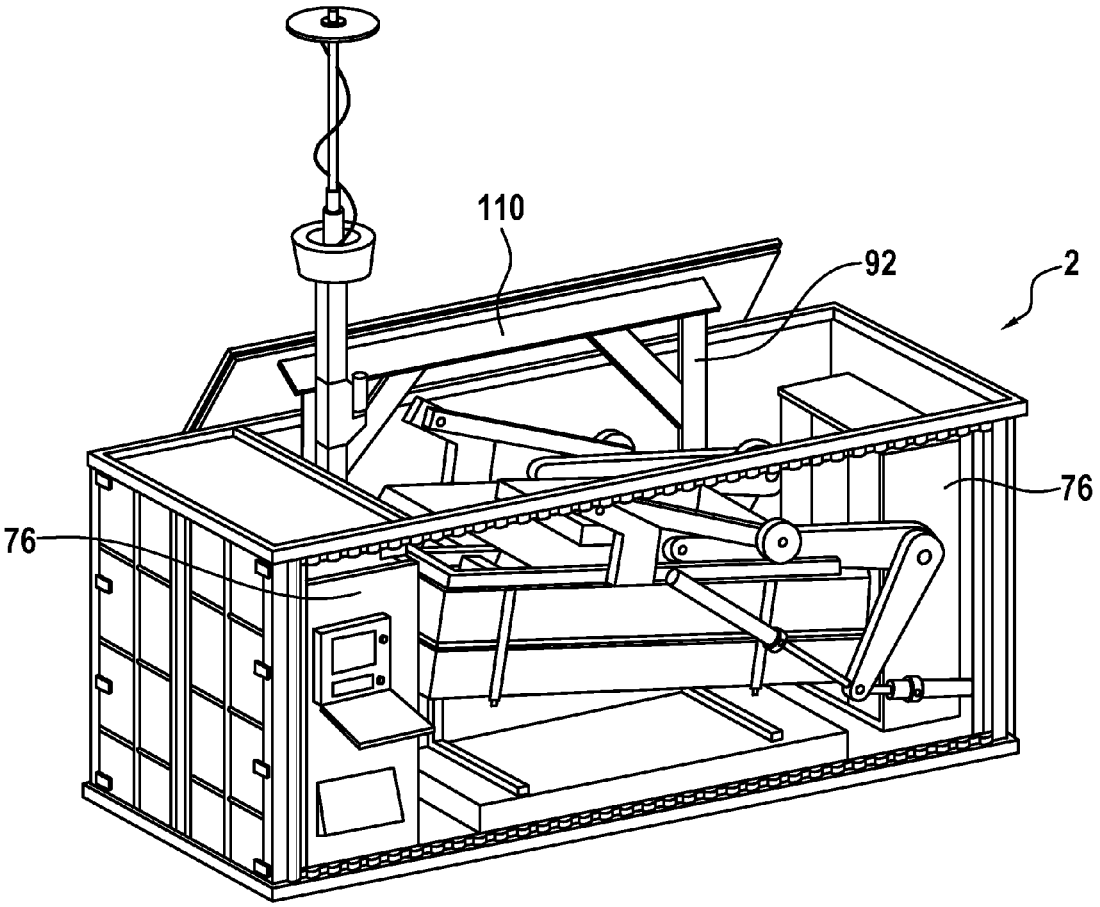
FIG. 10 shows the canisters with a starting pivoting process.

As can be seen from FIGS. 10 to 12, the translation movement phase of the canister is followed by a pivot phase, during which the canister 20 with a relatively small movement is strongly pivoted upwardly, specifically through 90°. During this phase, not only is the gravitation and therefore the gravitational force of the canisters 20 and the moving parts of the movement mechanism 26 to be overcome by the movement motors 48, but the strong pivoting movement is also to be carried out, which starts relatively efficiently after the translation movement phase and therefore a certain moment of inertia opposes the movement motors 48. In this regard, the greatest application of force for the movement motors 48 is to be provided during the first 90° pivoting of the canisters 20. For this purpose, the motor units 58, 60 are arranged relative to one another such that they act on the lever 64 in a mutually opposed manner during this phase and can thus apply forces particularly well. This is also true in particular because both thrust bar linkages are extended to a relatively short extent in this phase and the motor units 58, 60 are thus still in their most powerful pushing or pulling phase. The motor unit 58 in this case acts by pushing, and the motor unit 60 acts by pulling, wherein the motor unit 60 is also designed to apply a force by means of thrust, as is apparent in the movement phase shown in FIG. 13. From a rotation of approximately 180°, the motor unit 60 also acts by pushing on the lever 64 and thus brings the canisters 20 into their operating position, as is illustrated in FIG. 5.

To carry out a return movement from the operating position into the storage position, the motor unit 60 acts by pulling, whereas the motor unit 58, which is designed only to act by pushing, is entrained passively. The fact that only one of the motor units 58, 60 introduces the motor-driven force into the linkage 46 is not critical, since the load of the canisters 20 and of the holding unit 28 only has to be lifted slightly in order to reach the highest position, from which no more force pulling the canisters 20 has to be applied during the further course of the rearward movement.

Both in the operating position shown in FIG. 5 and in the storage position shown in FIG. 8 of the canisters 20 or of the movement mechanism 26 can the movement motors 48 remain held in a force-free manner. In the storage position, this is possible as can be easily seen, since the movement mechanism 26 is set down on the container floor or the base 30. Even in the operating position is the movement mechanism 26 set down however, in this exemplary embodiment on a set-down surface 82, for example the upper side of the rear container wall, as can be seen from FIG. 5. In this case, the underside of a supporting arm 80 of the movement mechanism 26 or of the holding unit 28 is located on the upper side (see FIG. 13) of the rear container wall. The gravitational force of the canisters 20 and of the holding unit 28 in this case holds the movement mechanism 26 and the canisters 20 in the operating position. Also in this position, the movement motor 48 can thus be held without force, and the canisters 20 remain securely in their operating position. The two inherently stable positions, that is to say the storage position and the operating position, have the advantage that an operator can enter the container housing 4 without risk and the movement motors 48 can be switched off without any risk posed by the movement mechanism 26 or the canisters 20. The hydraulic lines are also pressure less and are therefore safe.

During the entire course of movement from the storage position into the operating position, the canisters 20 perform a rotation through 270°. They are therefore not only lifted from the horizontal position into the vertical position, but are additionally rotated through 180°. This form of movement has the advantage that it is very compact and therefore has only a low spatial requirement, both inside and outside the container housing 4. In addition, it has the advantage that the rear side of the canisters faces away from the linkages 46 and the movement motors 48. This side is particularly easily accessible, and therefore this side is easily and quickly accessible when entering the container housing 4 or the container through the access door 6. Since conventional interfaces are rather located at the rear end of the canister 20, these can be easily connected.

For operation of the missile container 2, this is to be loaded with an operating object, for example a canister 20. Instead of the canister or canisters 20, other operating objects can also be used rather generally for the operation of the missile container 2. In this regard, the missile container 2 and operation thereof are not restricted to one or more canisters 20, but other operating objects can also be used, for example other holders for one or more missiles or other objects.

To load the missile container 2 with a canister 20 or another operating object, an operator can firstly open the cover 10 and activate the control means 62 via the input device 12. The operator then opens the container roof 14 by opening the roof wings 16, expediently via the input device 12 and the control means 62. To load the container housing 2 with an operating object, referred to hereinafter in a simplified manner as a canister 20, the operator can now move the movement mechanism 26 such that a set-down surface for the canisters 20, in the shown exemplary embodiment the base 30, is free in order to set down the canister 20 thereon. To this end, the movement mechanism 26 can be moved away from its storage position shown in FIGS. 7 and 8, for example into the operating position, which is illustrated in FIGS. 5 and 6. Canisters 20 are not yet fastened to the holding unit 28 at this moment in time.

A canister 20 can then be lowered from above into the container housing 4, for example using a crane. In this case, the roof opening 24 is opened to such an extent that the canister 20 can be lowered vertically from above onto the resting surface in the container housing 4, that is to say for example the base 30. In order to assist this set-down process, the operator can open the access door 6 of the container housing 4 and enter the interior of the missile container 2. The operator can thus use his hand to guide the canisters 20 fastened to crane ropes, for example, such that the holding members 70 are connected in a form-fitting manner between canister 20 and base 30, and the canister 20 is thus held in the storage position in a correctly positioned manner.

In this case, it is expedient if only part of the canister 20, which the holding unit 28 is designed to support, is introduced into the container housing 4. This is illustrated in FIG. 5, wherein it should be imagined that the missile canisters 20 on the holding unit 28 are not there. There is thus still sufficient space remaining within the container housing 4 for the operator to stand to the side of the canisters 20 and to thus guide the canisters 20 well into their storage position. Instead of the base 30, another suitable set-down unit can also be used. The loading position, in which one or more canisters is/are set down in the container housing 4 for connection to the holding unit 28 may also differ from the storage position. In the exemplary embodiment shown in the figures, the storage position is identical to the loading position however.

If the canister or canisters, in the exemplary embodiment four canisters 20 are shown, is/are set down in their loading position in the container housing 4, the operator can thus leave the container housing 4 again and allow the movement of the movement mechanism 26 towards the set-down canisters. This occurs expediently via the input device 12 and the control means 62, which expediently controls all movements of the movement mechanism 26. To this end, the control means 62 expediently comprises one or more control programs and electronic elements, such as a processor and data memory, which are necessary to run the control programs.

The holding unit 28 is guided in translation towards the lying canisters 20, as shown by the movement paths 72, 74 from FIG. 15, in the shown exemplary embodiment in translation vertically from above. Fastening means on the canister 20 and/or the holding unit 28 can thus be brought reliably into a holding position in which the canister 20 is firmly connected to the holding means 28. The holding means may be a detent means, which, as the holding unit 28 moves towards the canister 20, latches in such a way that the canister 20 is firmly connected to the holding unit 28.

The operator can now move the movement mechanism 26 into a loading position or, as is shown by way of example in the figures, into the operating position. In this position, the holding unit 28 is then located only with part of the canister that the holding unit 28 is designed to support. This is illustrated for example in FIG. 5.

A further canister 20 or further assembly comprising a plurality of canisters 20 can then be set down in the container housing 4, as described above. This situation is illustrated precisely in FIG. 5. The holding unit 28 can then be lowered again onto the stored canisters 20 and fastened thereto such that the holding unit 28 is then fully equipped. The missile container 2 is fully loaded and the loading process can be terminated as a result of the operator closing the container roof 14 again and protecting the display and input device 12 by the cover 10. The missile container 2 is then ready for transport or a relatively long period of storage.

To produce a state ready for operation, for example a combat-ready state of the missile container 2, this is expediently brought to a site of operation, for example to a building to be protected, to an oil platform, to a ship, to a commercial vehicle, or is placed on a floor, the possibilities for use being rather versatile. An operator can then open the cover 10 and activate the control means 62 via the input device 12, expediently using a protected access code. The container roof 14 is opened by pivoting out the roof wings 16, the antenna 22 is folded out, and the movement mechanism is brought from the storage position into the operating position, for example as described above. The canisters 20 or the missiles stored therein are now ready for operation, for example a launching.

A maintenance operation of the missile container 2 can likewise be carried out easily and efficiently. An operator can thus enter the interior of the container housing 4 by the access door 6 and inspect the canisters 20, for example. Since the rear face or front face of the canisters 20 are additionally facing towards the access door 6, interfaces on the canisters 20, which are conventionally located at their rear end, can be easily checked, or a checking device can be easily connected.

Sensors of the missiles can also be tested easily and quickly with the aid of the movement mechanism 26. For example, if a position sensor, a direction sensor, an inertial navigation system, an acceleration sensor or the like is to be checked, it is thus advantageous to read out measured values of this sensor at different positions of the missile or of the canister 20 storing the missile. For this purpose, the canister 20 can be moved for example into the four positions shown in FIGS. 8, 12, 13 and 5, in which the canister is in each case tilted by 90° to the other adjacent positions. Measured sensor values can be recorded, and an offset or scale factor of the sensor can be checked or established.

In order to bring the missile container 2 from its storage state into its combat state or operating state, the container roof 14 has to be opened in order to be able to guide the canisters 20 out from the container housing 4. To this end, the missile container 2 comprises roof elements, in the shown exemplary embodiment these are formed as roof wings 16, of which the function and movement will be explained hereinafter.

Figure 16:
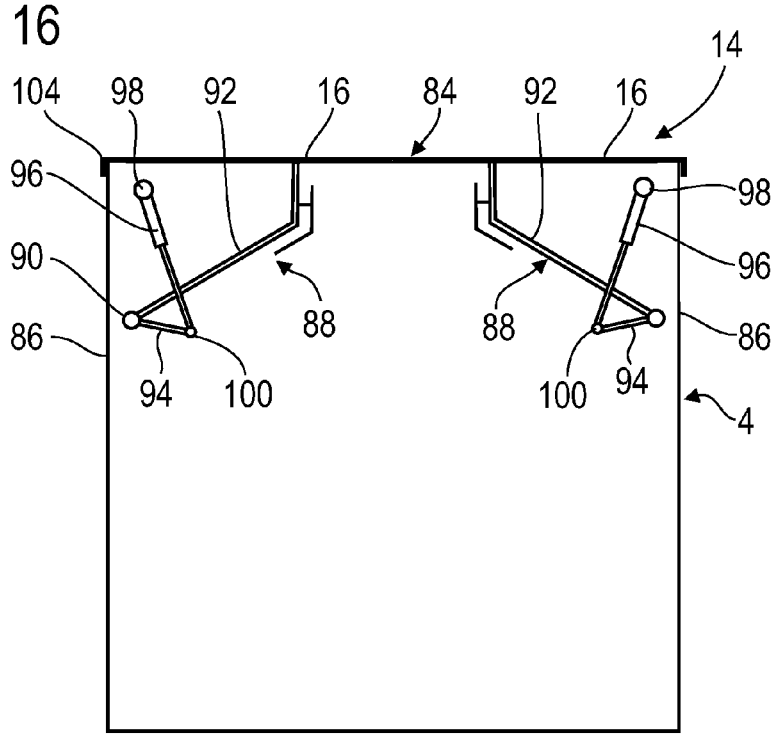
FIG. 16 shows a schematic illustration of two roof wings for opening and closing the container roof of a missile container from the previous figures.

FIG. 1 shows the roof wings 16 in a closed position, in which the container roof 14 is closed and the missile container 2 is sealed in a splashproof manner. This position of the roof wings 16 is reproduced in a schematic and simplified manner in FIG. 16. The container roof 14 has a movable roof unit, which in this exemplary embodiment comprises the two movable roof wings 16. The roof wings 16 each rest on a side wall of the container housing 4 of the missile container 2 and are supported inwardly by an opening device 88, or opening mechanism. The opening device 88 comprises a linking element 92, which is rotatable about a fixed axis 90 and is movable via a lever 92 by a motor unit 96.

The position of the fixed axis 90 is located in the inner volume of the container housing 4, such that the joint axes of the fixed axes 90 are arranged protected in the inner region of the missile container 2. The axes of rotation 90 of the roof wings 16 are located considerably below the roof line and within the container housing 4. The roof wings 16 can thus be fully opened with a pivot angle of significantly less than 90°. In addition, the roof wings 16 can be sealed outside the axis of rotation 90 and independently thereof. The fixed axes 90 are located between 25% and 30% of the container width of the container housing 4 below the container upper edge 102, which is formed in each case by the upper edge of the corresponding side wall 86, wherein the upper lateral roof edge 104 can also be considered as a container upper edge. In addition, the fixed axis 90 is located at a distance from the lateral container wall 86 of less than 5% of the container width.

The fixed axis 90 is an axis of rotation in the form of a fixed axis running parallel to the longitudinal direction of the roof wing 16. The axis of rotation is linked via a lever arm 94 to a lever rod fastened to the axis of rotation 90. The lever rod is attached to a motor unit 96 for actuation of the lever rod. The linking element is implemented from above, in particular via a pulling hydraulics.

The motor unit 96 comprises a thrust bar linkage, which is formed in this embodiment as a hydraulic cylinder. The motor unit 96 is in turn mounted pivotably in a fixed axis 98 and is movably connected via an articulation 100 to the linking element 92. The motor unit 96 is in this case effective by pulling, and its force thus develops in a pulling direction, that is to say with contraction.

To open the roof unit 84, the two motor units 96 are controlled by the control means 62, such that said motor units pivot the linking element 92 about the fixed axis 90. In this case, the two roof wings 16 lift upwardly and to the side, as can be seen in FIG. 17.

Figure 17:
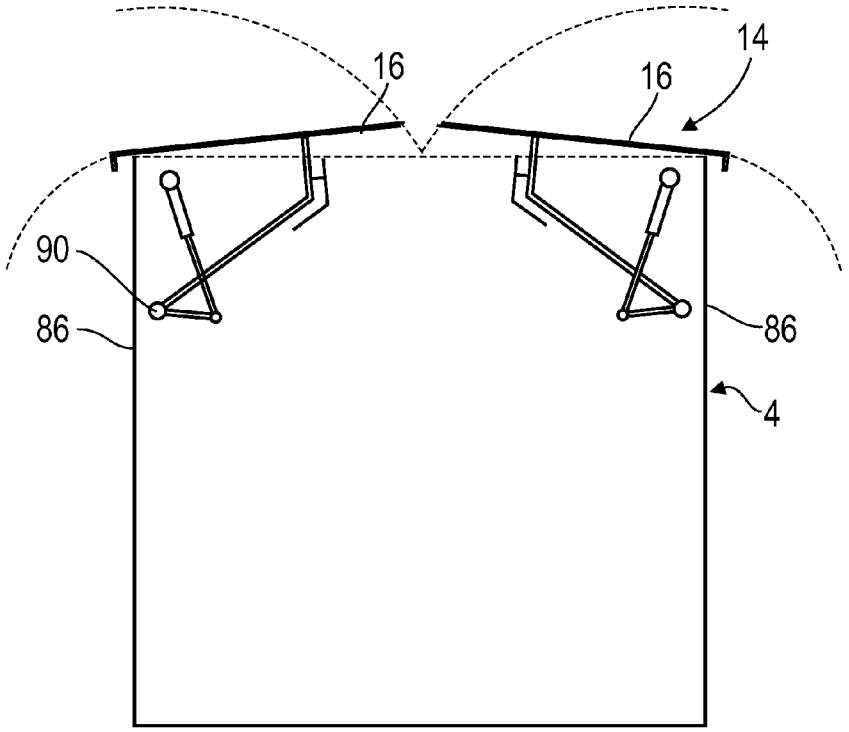
FIG. 17 shows the two roof wings in a slightly open position.

FIG. 17 shows the schematic illustration of the container housing 4 in a cut front view with slightly opened roof unit 84. The movement paths of the inner edge and of the outer side of the roof wings 16 are illustrated in a dashed manner. Due to the rotation of the roof wings 16, in each case about their fixed axis 90, the inner edges lift upwardly, and the outer sides move substantially outwardly in a sideways direction, that is to say become distanced from the side wall 86 in a lateral direction.

Figure 18:
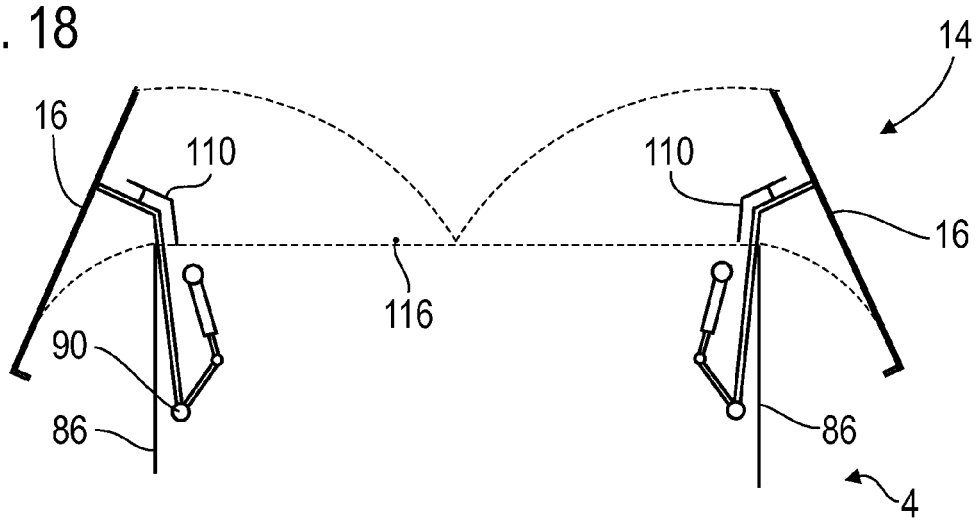
FIG. 18 shows the two roof wings in a fully open position.

FIG. 18 shows the roof unit 84 in the fully open position. The roof wings 16 are located to the side of the side walls 86, that is to say outside the virtual side plane of the container housing 4 spanned by the side walls 86. There is thus much space available to lower objects into the interior of the container housing 4 from above, for example in order to introduce the canisters 20 onto the base 30.

Figure 19:
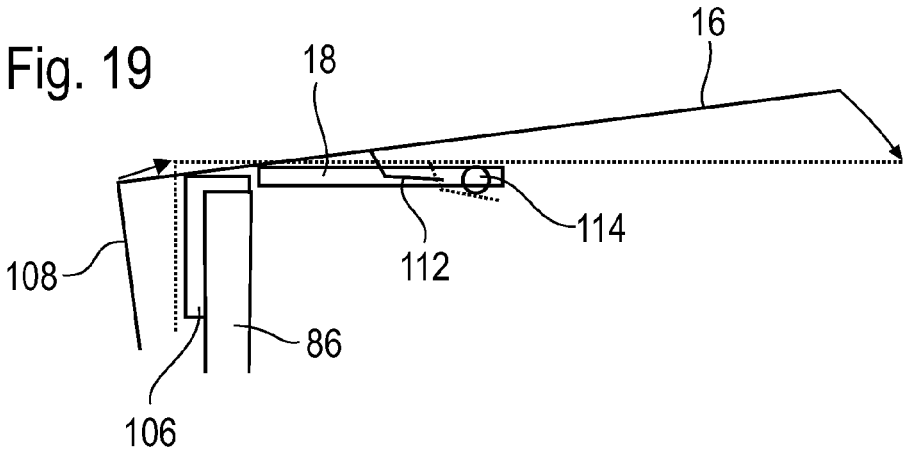
FIG. 19 shows a schematic detailed view of a roof wing shortly before and in the closed position.

As can be seen from FIG. 19, in the upper region of the side wall 86, a seal 106 is arranged, against which the corresponding roof wing 16 bears with its lateral overhang 108, via which the roof wing 16 engages around the side upper edge 102 of the container side wall 86 from above and to the side, when the wing 16 is closed. This overhang 108 pushes from the side from the outside against the seal 106. The closed position of the roof wing 16 is indicated by a dotted line in FIG. 19. It is also possible for the roof wing 16 to rest on the seal 106 from above if it engages around the side upper edge of the container side wall 86 from above, as is illustrated in FIG. 19. During closure, the outer edges of the roof wings 16 move with an angle of displacement of less than 10° to the horizontal towards the lateral container wall 26 and the seal 106.

Due to the overhang 108 overhanging laterally downwardly slightly, the roof wings 16 terminate very tightly against the side wall 86, such that even rain driven by wind cannot infiltrate the interior of the container housing 4 between the roof wings 16 and side wall 86. The opening movement of the roof unit 84 additionally has the advantage that water, sand or muck located on the container roof 14 slips laterally outwardly during the opening process and is guided away from the side wall 86 due to the sideways movement of the outer edge of the roof wings 16. Dirt or water thus flows off laterally from the roof wing 16 and falls down from the container side wall 86 at a distance. An infiltration of dirt, sand or water into the interior of the container is thus avoided.

To protect the seal 106, the roof unit is provided with an inner cover 110, wherein each roof wing 16 has an inner cover 110. The inner cover 110 overlaps the side upper edge 102 of the container housing 4 or the upper edge of the side wall 86 in the open state of the roof unit 84, such that said upper edge is protected against rain or falling dirt over the course of the inner cover 110. The inner cover 110 covers approximately 75% of the seal 106 and is formed as an elongate plate, which can be seen in FIGS. 4, 5, 8, 9 and 10. It is also clear from these figures that each roof wing 16 comprises two linking elements 92 and two motor units 96, such that each roof wing 16 can be lifted in a force-symmetrical manner and can be pivoted outwardly. So as not to collide with the movement mechanism 26, the rear linking element 92 can be placed slightly further forward compared to the position shown in the figures.

In order to keep the motor units 96 force-free in the open state of the roof unit 84, the linking elements 92 in the open state are supported on the side wall 86 of the container housing 4, as can be seen from FIG. 18. The motor units 96 can be connected in a force-free manner, and the roof wings 16, pushed to the side by their weight, remain securely in their open position. In the closed position, the roof wings 16 rest on the container side walls 86 and front and rear supports (not illustrated), such that, even in this position, the motor units 96 can be connected in a force-free manner and the roof unit 84 remains securely closed.

With a method for operating the missile container 2, an operator, once the cover 10 is open, controls the control means 62 via the input device 12 by means of corresponding commands to open the container roof 14 via the input device 12. The control unit 62 controls the motor units 96 of the roof unit 84, such that these bring the roof wings 16 from their closed position or shut position into their open position, as is illustrated in FIG. 18. The missile container 2 is thus brought from the closed state illustrated in FIG. 1 into the open state illustrated in FIG. 8. The movement mechanism 26 is then brought by the corresponding inputs of the operator at the input device 12 from the storage position illustrated in FIG. 8 into the operating position illustrated in FIG. 4. In this case, the movement mechanism 26, in the shown exemplary embodiment specifically the movable members 32, pushes against the roof flaps 18, which are illustrated in FIG. 2, shortly before the operating position is reached. Due to the inclined position of the two movable members 32, the roof flaps 18 are pushed downwardly into an open position against a spring force pushing in the shut position. The roof flaps 18 are closure means which release and close again a corresponding passage for the movement mechanism 26. The movement mechanism 26 moves completely in its operating position and leans against the rear wall of the container housing 4.

Due to corresponding commands in the input device 12, the antenna 22 is folded upwardly. It also pushes against a roof flap 18, which is illustrated in FIG. 1, such that this is pressed on downwardly. Alternatively, the antenna 22 can also be folded out before the movement mechanism 26 moves into its operating position.

By corresponding operating commands on the input device 12, the operator controls the closing of the roof unit 84, such that the two roof wings 16 close again and reach the shut position illustrated in FIG. 3. As the roof wings 16 are closed, the container roof 14 is fully closed. The openings in the container roof 14 released by the roof flaps 18 are then used so that the antenna 22 and the movement mechanism 26 can be guided through the closed container roof 14 without the roof unit 84 having to be open for this purpose. The missile container 2 can thus be kept closed even in its operating position, wherein it is expediently closed in a splashproof manner in this position. Rain or dust flying around therefore does not reach the interior of the container.

If the missile container 2 is to be brought again into its storage state, the roof unit 84 can thus be opened again and the antenna 22 and the movement mechanism 26 brought again into the storage position. In this case, the corresponding elements move out from the passages and the roof flaps 18 move back into their shut position in a spring-driven manner. The passages are thus closed, such that, as the roof wings 16 close, the container roof 14 is again closed. In order to prevent the roof flaps from pressing down in the closed state, form-fit means 112 (see FIG. 19) of the roof wings 16 engage behind holding means 114 of the closed closure means or roof flaps 18. This is illustrated in FIG. 19, from which it can be seen that a form-fit means 112 advances laterally towards the holding means 114 and engages the holding means from behind and below, such that the form-fit means 112 and the holding means 114 form a form fit. The roof flap 18 is now no longer able to press downwards, since the holding means 114 rests on the form-fit means 112.

The roof wings 16 are fastened in their shut position such that a housing-fixed securing means 116 (see FIG. 18), which for example can be formed as a retaining pin, runs into the upper roof wing from the front and thus blocks an opening movement of the roof wing. The upper roof wing 16, in FIG. 18 the left roof wing, overlaps the lower roof wing 16, in FIG. 18 the right roof wing 16, in the inner region in the shut position. Due to this overlap, the lower roof wing 16 is also prevented from moving out from the closure position without an opening of the upper roof wing 16.

Figure 20:
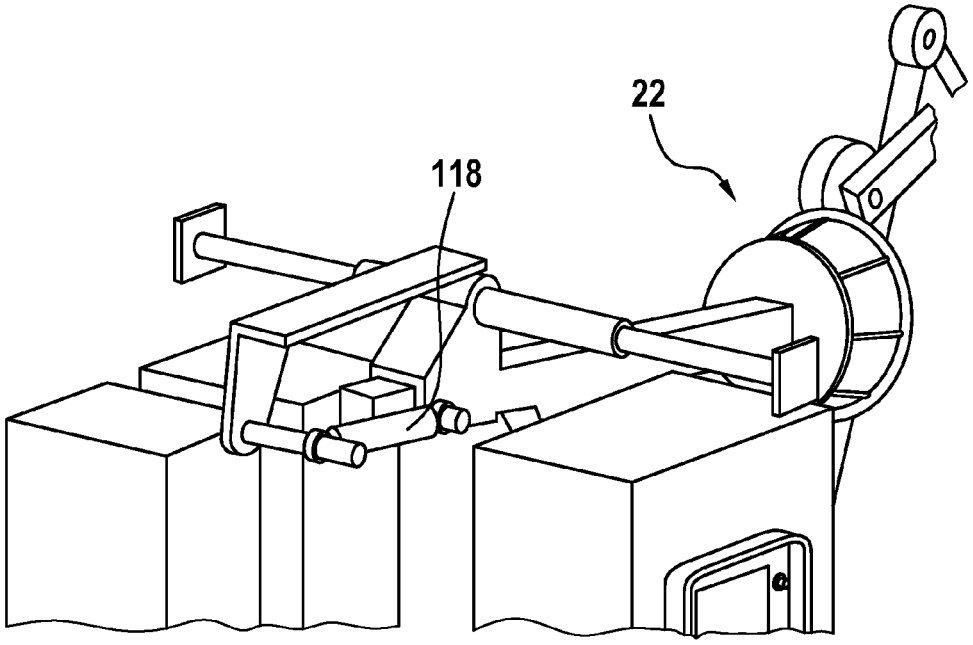
FIG. 20 shows an antenna in a storage position.
Figure 21:
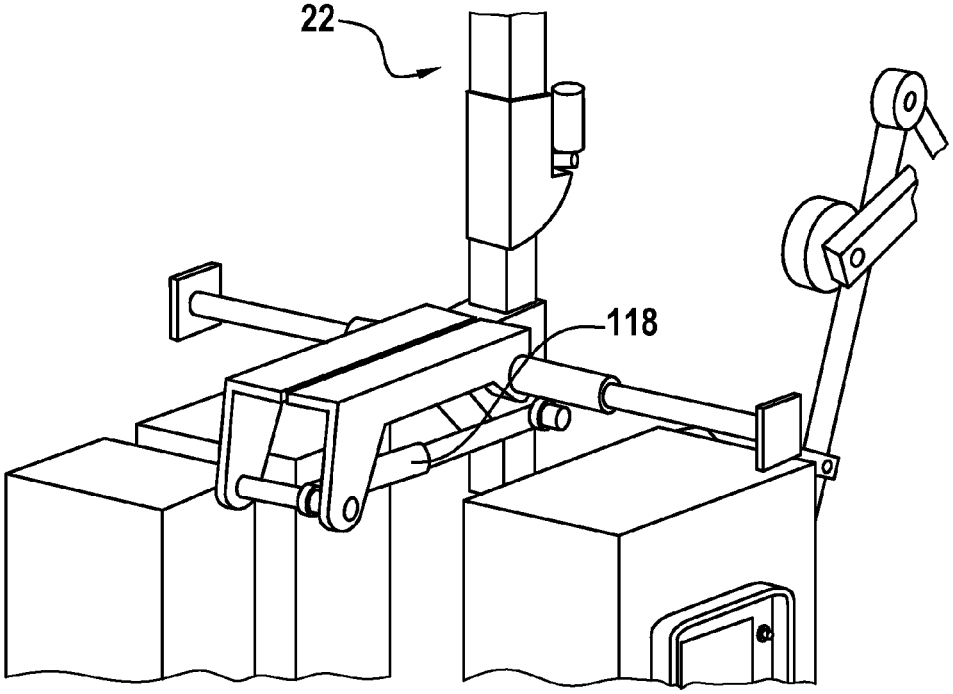
FIG. 21 shows the antenna mechanism from FIG. 20 in an operating position of the antenna.

FIGS. 20 and 21 show the antenna 22 in a storage state of the missile container 2 (FIG. 1 and FIG. 20) and an operating state of the missile container 2 (FIG. 3 and FIG. 21). Due to a movement motor 118 in the form of a hydraulic cylinder, the antenna 22 is folded out from the position located fully in the inner volume of the container into a vertical position, in which the antenna 22 protrudes through the roof opening 24. The movement motor generates, from a linear movement, a rotation of the antenna 22 about an axis of rotation. The antenna 22 is also folded in by the movement motor 118.

The following is a summary list of reference numerals and the corresponding structure used in the above description of the invention:

2 missile container
4 container housing
6 access door
8 interface
10 cover
12 display and input means
14 container roof
16 roof wing
18 roof flap
20 canister
22 antenna
24 roof opening
26 movement means
28 holding unit
30 base
32 movable member
34 movable member
36 rotation point
38 rotation point
40 rotation point
42 rotation point
44 coupler
46 linkage
48 movement motor
50 fixed axis
52 fixed axis
54 axis
56 pivot axis
58 motor unit
60 motor unit
62 control means
64 lever
66 fixed axis
68 fixed axis
70 holding member
72 movement path
74 movement path
76 switch cabinet
78 centre of rotation
80 support arm
82 upper side
84 roof unit
86 side wall
88 opening means
90 axis of rotation
92 linking element
94 lever
96 motor unit
98 fixed axis
100 articulation
102 container upper edge
104 roof edge
106 seal
108 overhang
110 inner cover
112 form-fit means
114 holding means
116 securing means
118 movement motor

The invention claimed is:

1. A missile container, comprising:

a container housing and a container roof, said container roof having at least one roof wing resting on said container housing, said roof wing being mounted pivotably about a single axis of rotation;

at least one canister for supporting a missile arranged in a horizontal storage position in said container housing; and a mechanism for moving said at least one canister from the horizontal storage position into a vertical operating position, said mechanism including a motor and a holder for said at least one canister;

said mechanism holding said at least one canister at least partially outside said container housing in the vertical operating position, and said container roof being closed and outwardly shielding a container interior when said at least one canister is held by said mechanism in the vertical operating position.

2. The missile container according to claim 1, wherein said container roof is formed with a passage opening and said mechanism projects through said passage opening in the vertical operating position and when said container roof closes a roof opening, and wherein said passage opening is closed by a roof flap when said mechanism is moved out of said passage opening.

3. The missile container according to claim 2, wherein said roof flap and said mechanism are disposed with respect to each other such that said mechanism presses on said roof flap by moving into the vertical operating position.

4. The missile container according to claim 1, wherein said roof wing engages around an upper edge of a sidewall of said container housing from above and to the side.

5. The missile container according to claim 1, which comprises an opening device for opening said roof wing by pivoting said roof wing upwards and to the side.

6. The missile container according to claim 1, wherein said axis of rotation is arranged by more than 25% of the container width below a container upper edge on which said roof wing rests.

7. The missile container according to claim 1, further comprising an opening device for moving said roof wing by pivoting said roof wing to move an exterior side of said roof wing during closure with an angle of displacement of less than 10° relative to the horizontal towards a container sidewall.

8. The missile container according to claim 1, wherein said roof wing has an inner cover which, in an open state, covers and protects an upper edge of a sidewall of said container housing.

9. The missile container according to claim 1, wherein, in an open state thereof, said roof wing is supported on a sidewall of said container housing such that an opening device for opening said roof wing is force-free.

10. The missile container according to claim 1, wherein said container housing has a side wall and said vertical operating position is adjacent said side wall.

11. A method of operating a missile container having a container housing, a container roof, and at least one canister for supporting a missile, the method comprising:

opening a roof wing of the container housing by pivoting the roof wing to open a roof opening;

moving the canister with a movement mechanism from a horizontal storage position in the container housing through the roof opening into a vertical operating position;

with the canister in the vertical operating position, closing the roof wing to thereby close the roof opening with the movement mechanism holding said at least one canister at least partially outside the container housing in the vertical operating position.

12. The method according to claim 11, wherein the moving step comprises pressing with the movement mechanism on a closure of the container roof, whereupon the closure releases a passage opening in the container roof.

13. The method according to claim 12, which comprises moving the movement mechanism out of the vertical operating position, whereupon the closure is spring-driven and closes.

14. The method according to claim 11, wherein the roof wing, upon being moved out of a closed position thereof, pivots sideways and at the same time moves to the side such that any water on the roof wing flows off laterally and drops off at a lateral spacing distance from the container side wall.

15. A missile container, comprising:

a container housing, container wall and a container roof, said container roof having at least two roof wings resting on said container housing, each of said roof wings being openable by an opening device by pivoting each of said roof wings upwards and to the side, each of said roof wings being liftable from said container housing, each of said roof wings being mounted pivotably about a respective single axis of rotation, each said respective single axis of rotation being disposed more that 5% of a width of the container under an upper edge of said container on which said roof wings rest for achieving lateral movement of each of said roof wings, each said respective single axis of rotation being disposed by less than 20% of the width away from said container wall for eliminating or minimizing a lateral dipping of said roof wings at a beginning of opening;

at least one canister for supporting a missile arranged in a storage position in said container housing; and a mechanism for moving said at least one canister from the storage position into an operating position, said mechanism including a motor and a holder for said at least one canister;

said mechanism holding said at least one canister at least partially outside said container housing in the operating position, and said container roof being closed and outwardly shielding a container interior when said at least one canister is in the operating position.

16. A missile container, comprising:

a container housing having a roof opening, a container roof covering said roof opening, a footprint, and a sidewall;

at least one canister for supporting a missile arranged in a storage position in said container housing; and a mechanism for moving said at least one canister through said roof opening from the storage position into an operating position, said mechanism including a motor and a holder for said at least one canister, the operating position being adjacent the side wall outside the footprint of the container housing;

said mechanism holding said at least one canister in the operating position, and said container roof being closed and outwardly shielding a container interior when said at least one canister is held by said mechanism in the operating position.

17. The missile container according to claim 16, wherein said container roof has at least one roof wing resting on said container housing.

18. The missile container according to claim 16, wherein said operating position is a launching position of the missile.

* * * * *